US008532998B2

(12) United States Patent
Gao

(10) Patent No.: US 8,532,998 B2
(45) Date of Patent: Sep. 10, 2013

(54) SELECTIVE BANDWIDTH EXTENSION FOR ENCODING/DECODING AUDIO/SPEECH SIGNAL

(75) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 824 days.

(21) Appl. No.: 12/554,638

(22) Filed: Sep. 4, 2009

(65) Prior Publication Data

US 2010/0063827 A1 Mar. 11, 2010

Related U.S. Application Data

(60) Provisional application No. 61/094,881, filed on Sep. 6, 2008.

(51) Int. Cl.
*G10L 19/00* (2013.01)

(52) U.S. Cl.
USPC ..... 704/500; 704/501; 704/502; 704/200; 704/201; 704/203

(58) Field of Classification Search
USPC ..... 704/500, 501, 502, 201, 203, 220, 704/223, 200
See application file for complete search history.

(56) References Cited

U.S. PATENT DOCUMENTS

| | | | |
|---|---|---|---|
| 5,828,996 | A | 10/1998 | Iijima et al. |
| 5,974,375 | A | 10/1999 | Aoyagi et al. |
| 6,018,706 | A | 1/2000 | Huang et al. |
| 6,507,814 | B1 | 1/2003 | Gao |
| 6,629,283 | B1 | 9/2003 | Toyama |
| 6,708,145 | B1 | 3/2004 | Liljeryd et al. |
| 7,216,074 | B2 | 5/2007 | Malah et al. |
| 7,328,160 | B2 | 2/2008 | Nishio et al. |
| 7,328,162 | B2 | 2/2008 | Liljeryd et al. |
| 7,359,854 | B2 | 4/2008 | Nilsson et al. |
| 7,433,817 | B2 | 10/2008 | Kjörling et al. |
| 7,447,631 | B2 | 11/2008 | Truman et al. |
| 7,469,206 | B2 | 12/2008 | Kjörling et al. |
| 7,546,237 | B2 | 6/2009 | Nongpiur et al. |
| 7,627,469 | B2 | 12/2009 | Nettre et al. |
| 2002/0002456 | A1 | 1/2002 | Vainio et al. |
| 2003/0093278 | A1 | 5/2003 | Malah |
| 2003/0200092 | A1 | 10/2003 | Gao et al. |

(Continued)

FOREIGN PATENT DOCUMENTS

WO WO 2007/087824 * 8/2007

OTHER PUBLICATIONS

International Search Report and Written Opinion, International application No. PCT/US2009/056111, Date of mailing Oct. 23, 2009, 13 pages.

(Continued)

*Primary Examiner* — Qi Han
(74) *Attorney, Agent, or Firm* — Slater & Matsil, L.L.P.

(57) ABSTRACT

A method of receiving an audio signal includes measuring a periodicity of the audio signal to determine a checked periodicity. At least one best available subband is determined. At least one extended subband is composed, wherein composing includes reducing a ratio of composed harmonic components to composed noise components if the checked periodicity is lower than a threshold, and scaling a magnitude of the at least one extended subband based on a spectral envelope on the audio signal.

27 Claims, 8 Drawing Sheets

(56) References Cited

U.S. PATENT DOCUMENTS

| | | | | |
|---|---|---|---|---|
| 2004/0015349 | A1 | 1/2004 | Vinton et al. | |
| 2004/0181397 | A1 | 9/2004 | Gao | |
| 2004/0225505 | A1 | 11/2004 | Andersen et al. | |
| 2005/0159941 | A1 | 7/2005 | Kolesnik et al. | |
| 2005/0165603 | A1 | 7/2005 | Bessette et al. | |
| 2005/0278174 | A1 | 12/2005 | Sasaki et al. | |
| 2006/0036432 | A1 | 2/2006 | Kjorling et al. | |
| 2006/0147124 | A1 | 7/2006 | Edler et al. | |
| 2006/0271356 | A1 | 11/2006 | Vos | |
| 2007/0088558 | A1 | 4/2007 | Vos et al. | |
| 2007/0255559 | A1 | 11/2007 | Gao et al. | |
| 2007/0282603 | A1 | 12/2007 | Bessette | |
| 2007/0299662 | A1 | 12/2007 | Kim et al. | |
| 2007/0299669 | A1 | 12/2007 | Ehara | |
| 2008/0010062 | A1 | 1/2008 | Son et al. | |
| 2008/0027711 | A1* | 1/2008 | Rajendran et al. | 704/201 |
| 2008/0052066 | A1 | 2/2008 | Oshikiri et al. | |
| 2008/0052068 | A1 | 2/2008 | Aguilar et al. | |
| 2008/0091418 | A1 | 4/2008 | Laaksonen et al. | |
| 2008/0120117 | A1 | 5/2008 | Choo et al. | |
| 2008/0126081 | A1 | 5/2008 | Geiser et al. | |
| 2008/0126086 | A1 | 5/2008 | Vos et al. | |
| 2008/0154588 | A1 | 6/2008 | Gao | |
| 2008/0195383 | A1 | 8/2008 | Shlomot et al. | |
| 2008/0208572 | A1 | 8/2008 | Nongpiur et al. | |
| 2009/0024399 | A1* | 1/2009 | Gartner et al. | 704/500 |
| 2009/0125301 | A1 | 5/2009 | Master et al. | |
| 2009/0254783 | A1 | 10/2009 | Hirschfeld et al. | |
| 2010/0063802 | A1 | 3/2010 | Gao | |
| 2010/0063803 | A1 | 3/2010 | Gao | |
| 2010/0063810 | A1 | 3/2010 | Gao | |
| 2010/0070269 | A1 | 3/2010 | Gao | |
| 2010/0070270 | A1 | 3/2010 | Gao | |
| 2010/0121646 | A1 | 5/2010 | Ragot et al. | |
| 2010/0211384 | A1 | 8/2010 | Qi et al. | |
| 2010/0292993 | A1 | 11/2010 | Vaillancourt et al. | |

OTHER PUBLICATIONS

"G.729-based embedded variable bit-rate coder: An 8-32 kbit/s scalable wideband coder bitstream interoperable with G.729," Series G: Transmission Systems and Media, Digital Systems and Networks, Digital terminal equipments—Coding of analogue signals by methods other than PCM, International Telecommunication Union, ITU-T Recommendation G.729.1 May 2006, 100 pages.

International Search Report and Written Opinion, International Application No. PCT/US2009/056106, Huawei Technologies Co., Ltd., Date of Mailing Oct. 19, 2009, 11 pages.

International Search Report and Written Opinion, International Application No. PCT/US2009/056113, Huawei Technologies Co., Ltd., Date of Mailing Oct. 22, 2009, 10 pages.

International Search Report and Written Opinion, International Application No. PCT/US2009/056117, Gh Innovation, Inc., Date of Mailing Oct. 19, 2009, 8 pages.

International Search Report and Written Opinion, International Application No. PCT/US2009/056860, Huawei Technologies Co., Ltd., Inc., Date of Mailing Oct. 26, 2009, 11 page.

International Search Report and Written Opinion, International Application No. PCT/US2009/056981, GH Innovation, Inc., Date of Mailing Nov. 2, 2009, 11 pages.

* cited by examiner

SELECTIVE BANDWIDTH EXTENSION FOR ENCODING/DECODING AUDIO/SPEECH SIGNAL

This patent application claims priority to U.S. Provisional Application No. 61/094,881, filed on Sep. 6, 2008, entitled "Selective Bandwidth Extension," which application is incorporated by reference herein.

TECHNICAL FIELD

The present invention relates generally to signal coding, and, in particular embodiments, to a system and method utilizing selective bandwidth extension.

BACKGROUND

In modern audio/speech signal compression technology, a concept of BandWidth Extension (BWE) is widely used. This technology concept sometimes is also called High Band Extension (HBE), SubBand Replica (SBR), or Spectral Band Replication (SBR). Although the name could be different, they all have the similar meaning of encoding/decoding some frequency sub-bands (usually high bands) with little budget of bit rate (or even zero budget of bit rate), or significantly lower bit rate than normal encoding/decoding approaches.

There are two basic types of BWE. One is to generate subbands in high frequency area without spending any bits. For example, a high frequency spectral envelope is produced or predicted according to low band spectral envelope. Such a spectral envelope is often represented by LPC (Linear Prediction Coding) technology. The spectral fine spectrum in high frequency area, which is corresponding to a time domain excitation that is copied from a low frequency band, or artificially generated at decoder side.

In another type of BWE, some perceptually critical information (such as spectral envelope) are encoded or decoded within a small bit budget while some information (such as spectral fine structure) are generated with very limited bit budget (or without the cost of any bits). Such a BWE usually comprises frequency envelope coding, temporal envelope coding (optional), and spectral fine structure generation. The precise description of the spectral fine structure needs a lot of bits, which becomes not realistic for any BWE algorithm. A realistic way is to artificially generate spectral fine structure, which means that spectral fine structure is copied from other bands or mathematically generated according to limited available parameters.

Frequency domain can be defined as FFT transformed domain. It can also be in a Modified Discrete Cosine Transform (MDCT) domain. A well-known prior art description of BWE can be found in the standard ITU G.729.1 in which the algorithm is named Time Domain Bandwidth Extension (TDBWE)

General Description of ITU-T G.729.1

ITU-T G.729.1 is also called a G.729EV coder, which is an 8-32 kbit/s scalable wideband (50 Hz-7,000 Hz) extension of ITU-T Rec. G.729. By default, the encoder input and decoder output are sampled at 16,000 Hz. The bitstream produced by the encoder is scalable and has 12 embedded layers, which will be referred to as Layers 1 to 12. Layer 1 is the core layer corresponding to a bit rate of 8 kbit/s. This layer is compliant with G.729 bitstream, which makes G.729EV interoperable with G.729. Layer 2 is a narrowband enhancement layer adding 4 kbit/s, while Layers 3 to 12 are wideband enhancement layers adding 20 kbit/s with steps of 2 kbit/s.

The G.729EV coder is designed to operate with a digital signal sampled at 16,000 Hz followed by a conversion to 16-bit linear PCM before the converted signal is inputted to the encoder. However, the 8,000 Hz input sampling frequency is also supported. Similarly, the format of the decoder output is 16-bit linear PCM with a sampling frequency of 8,000 or 16,000 Hz. Other input/output characteristics should be converted to 16-bit linear PCM with 8,000 or 16,000 Hz sampling before encoding, or from 16-bit linear PCM to the appropriate format after decoding. The bitstream from the encoder to the decoder is defined within this Recommendation.

The G.729EV coder is built upon a three-stage structure: embedded Code-Excited Linear-Prediction (CELP) coding, Time-Domain Bandwidth Extension (TDBWE), and predictive transform coding that is also referred to as Time-Domain Aliasing Cancellation (TDAC). The embedded CELP stage generates Layers 1 and 2, which yield a narrowband synthesis (50 Hz-4,000 Hz) at 8 kbit/s and 12 kbit/s. The TDBWE stage generates Layer 3 and allows producing a wideband output (50 Hz-7,000 Hz) at 14 kbit/s. The TDAC stage operates in the MDCT domain and generates Layers 4 to 12 to improve quality from 14 kbit/s to 32 kbit/s. TDAC coding represents the weighted CELP coding error signal in the 50 Hz-4,000 Hz band and the input signal in the 4,000 Hz-7,000 Hz band.

The G.729EV coder operates on 20 ms frames. However, the embedded CELP coding stage operates on 10 ms frames, such as G.729 frames. As a result, two 10 ms CELP frames are processed per 20 ms frame. In the following, to be consistent with the context of ITU-T Rec. G.729, the 20 ms frames used by G.729EV will be referred to as superframes, whereas the 10 ms frames and the 5 ms subframes involved in the CELP processing will be called frames and subframes, respectively.

G729.1 Encoder

A functional diagram of the encoder part is presented in FIG. 1. The encoder operates on 20 ms input superframes. By default, the input signal 101, $s_{WB}(n)$, is sampled at 16,000 Hz. Therefore, the input superframes are 320 samples long. The input signal $s_{WB}(n)$ is first split into two sub-bands using a QMF filter bank defined by filters $H_1(z)$ and $H_2(z)$. The lower-band input signal 102, $s_{LB}^{qmf}(n)$, obtained after decimation is pre-processed by a high-pass filter $H_{h1}(z)$ with a 50 Hz cut-off frequency. The resulting signal 103, $s_{LB}(n)$, is coded by the 8-12 kbit/s narrowband embedded CELP encoder. To be consistent with ITU-T Rec. G.729, the signal $s_{LB}(n)$ will also be denoted as s(n). The difference 104, $d_{LB}(n)$ between s(n) and the local synthesis 105, $\hat{s}_{enh}(n)$ of the CELP encoder at 12 kbit/s is processed by the perceptual weighting filter $W_{LB}(Z)$. The parameters of $W_{LB}(z)$ are derived from the quantized LP coefficients of the CELP encoder. Furthermore, the filter $W_{LB}(z)$ includes a gain compensation which guarantees the spectral continuity between the output 106, $d_{LB}^{w}(n)$, of $W_{LB}(z)$ and the higher-band input signal 107, $s_{HB}(n)$. The weighted difference $d_{LB}^{w}(n)$ is then transformed into frequency domain by MDCT. The higher-band input signal 108, $s_{HB}^{fold}(n)$, which is obtained after decimation and spectral folding by $(-1)^n$, is pre-processed by a low-pass filter $H_{h2}(z)$ with a 3,000 Hz cut-off frequency. The resulting signal $s_{HB}(n)$ is coded by the TDBWE encoder. The signal $s_{HB}$ (n) is also transformed into frequency domain by MDCT. The two sets of MDCT coefficients, 109, $D_{LB}^{w}(k)$, and 110, $S_{HB}(k)$, are finally coded by the TDAC encoder. In addition, some parameters are transmitted by the frame erasure concealment (FEC) encoder in order to introduce parameter-level redundancy in the bitstream. This redundancy results in an improved quality in the presence of erased superframes.

TDBWE Encoder

The TDBWE encoder is illustrated in FIG. 2. The TDBWE encoder extracts a fairly coarse parametric description from the pre-processed and down-sampled higher-band signal 201, $s_{HB}(n)$. This parametric description comprises time envelope 202 and frequency envelope 203 parameters. The 20 ms input speech superframe $s_{HB}(n)$ (with a 8 kHz sampling frequency) is subdivided into 16 segments of length 1.25 ms each, for example. Therefore each segment comprises 10 samples. The 16 time envelope parameters 102, Tenv(i), i=0, . . . , 15, are computed as logarithmic subframe energies, on which a quantization is performed. For the computation of the 12 frequency envelope parameters 203, Fenv(j), j=0, . . . , 11, the signal 201, $s_{HB}(n)$, is windowed by a slightly asymmetric analysis window. This window is 128 tap long (16 ms) and is constructed from the rising slope of a 144-tap Hanning window, followed by the falling slope of a 112-tap Hanning window. The maximum of the window is centered on the second 10 ms frame of the current superframe. The window is constructed such that the frequency envelope computation has a lookahead of 16 samples (2 ms) and a lookback of 32 samples (4 ms). The windowed signal is transformed by FFT. The even bins of the full length 128-tap FFT are computed using a polyphase structure. Finally, the frequency envelope parameter set is calculated as logarithmic weighted sub-band energies for 12 evenly spaced overlapping sub-bands with equal widths in the FFT domain.

G729.1 Decoder

A functional diagram of the decoder is presented in FIG. 3. The specific case of frame erasure concealment is not considered in this figure. The decoding depends on the actual number of received layers or equivalently on the received bit rate.

If the received bit rate is:

8 kbit/s (Layer 1): The core layer is decoded by the embedded CELP decoder to obtain 301, $\hat{s}_{LB}(n)=\hat{s}(n)$. Then $\hat{s}_{LB}(n)$ is post-filtered into 302, $\hat{s}_{LB}^{post}(n)$ and post-processed by a high-pass filter (HPF) into 303, $\hat{s}_{LB}^{qmf}(n)=\hat{s}_{LB}^{hpf}(n)$. The QMF synthesis filter-bank defined by the filters $G_1(z)$ and $G_2(z)$ generates the output with a high-frequency synthesis 304, $\hat{s}_{HB}^{qmf}(n)$, set to zero.

12 kbit/s (Layers 1 and 2): The core layer and narrowband enhancement layer are decoded by the embedded CELP decoder to obtain 301, $\hat{s}_{LB}(n)=\hat{s}_{enh}(n)$. $\hat{s}_{LB}(n)$ is then post-filtered into 302, $\hat{s}_{LB}^{post}(n)$ and high-pass filtered to obtain 303, $\hat{s}_{LB}^{qmf}(n)=\hat{s}_{LB}^{hpf}(n)$. The QMF synthesis filter-bank generates the output with a high-frequency synthesis 304, $\hat{s}_{HB}^{qmf}(n)$ set to zero.

14 kbit/s (Layers 1 to 3): In addition to the narrowband CELP decoding and lower-band adaptive post-filtering, the TDBWE decoder produces a high-frequency synthesis 305, $\hat{s}_{HB}^{bwe}$, which is then transformed into frequency domain by MDCT so as to zero the frequency band above 3,000 Hz in the higher-band spectrum 306, $\hat{S}_{HB}^{bwe}(k)$. The resulting spectrum 307, $\hat{S}_{HB}(k)$, is transformed in time domain by inverse MDCT and overlap-added before spectral folding by $(-1)^n$. In the QMF synthesis filter-bank, the reconstructed higher band signal 304, $\hat{s}_{HB}^{qmf}(n)$ is combined with the respective lower band signal 302, $\hat{s}_{LB}^{qmf}(n)=\hat{s}_{LB}^{post}(n)$, and is reconstructed at 12 kbit/s without high-pass filtering.

Above 14 kbit/s (Layers 1 to 4+): In addition to the narrowband CELP and TDBWE decoding, the TDAC decoder reconstructs MDCT coefficients 308, $\hat{D}_{LB}^{w}(k)$ and 307, $\hat{S}_{HB}(k)$, which correspond to the reconstructed weighted difference in lower band (0-4,000 Hz) and the reconstructed signal in higher band (4,000-7,000 Hz). Note that in the higher band, the non-received sub-bands and the sub-bands with zero-bit allocation in TDAC decoding are replaced by the level-adjusted sub-bands of $\hat{S}_{HB}^{bwe}(k)$. Both $\hat{D}_{LB}^{w}(k)$ and $\hat{S}_{HB}(k)$ are transformed into time domain by inverse MDCT and overlap-add. The lower-band signal 309, $\hat{d}_{LB}^{w}(n)$, is then processed by the inverse perceptual weighting filter $W_{LB}(z)^{-1}$. To attenuate transform coding artifacts, pre/post-echoes are detected and reduced in both the lower-band and higher-band signals 310, $\hat{d}_{LB}(n)$ and 311, $\hat{s}_{HB}(n)$. The lower-band synthesis $\hat{s}_{LB}(n)$ is post-filtered, while the higher-band synthesis 312, $\hat{s}_{HB}^{fold}(n)$, is spectrally folded by $(-1)^n$. The signals $\hat{s}_{LB}^{qmf}(n)=\hat{s}_{LB}^{post}(n)$ and $\hat{s}_{HB}^{qmf}(n)$ are then combined and upsampled in the QMF synthesis filterbank.

TDBWE Decoder

FIG. 4 illustrates the concept of the TDBWE decoder module. The parameters received by the TDBWE parameter decoding block, which are computed by parameter extraction procedure, are used to shape an artificially generated excitation signal 402, $\hat{s}_{HB}^{exc}(n)$, according to desired time and frequency envelopes $\hat{T}_{env}(i)$ and $\hat{F}_{env}(j)$. This is followed by a time-domain post-processing procedure.

The TDBWE excitation signal 401, exc(n), is generated by a 5 ms subframe based on parameters that are transmitted in Layers 1 and 2 of the bitstream. Specifically, the following parameters are used: the integer pitch lag $T_0=\text{int}(T_1)$ or int $(T_2)$ depending on the subframe, the fractional pitch lag frac, the energy Ec of the fixed codebook contributions, and the energy Ep of the adaptive codebook contribution. Energy Ec is mathematically expressed as $$E_c = \sum_{n=0}^{39} (\hat{g}_c \cdot c(n) + \hat{g}_{enh} \cdot c'(n))^2.$$

Energy Ep is expressed as $$E_p = \sum_{n=0}^{39} (\hat{g}_p \cdot v(n))^2.$$

Very detailed description can be found in the ITU G.729.1 Recommendation.

The parameters of the excitation generation are computed every 5 ms subframe. The excitation signal generation consists of the following steps:

Estimation of two gains $g_v$ and $g_{uv}$ for the voiced and unvoiced contributions to the final excitation signal exc(n);

pitch lag post-processing;

generation of the voiced contribution;

generation of the unvoiced contribution; and low-pass filtering.

In G.729.1, TDBWE is used to code the wideband signal from 4 kHz to 7 kHz. The narrow band (NB) signal from 0 to 4 kHz is coded with G.729 CELP coder where the excitation consists of a adaptive codebook contribution and a fixed codebook contribution. The adaptive codebook contribution comes from the voiced speech periodicity. The fixed codebook contributes to unpredictable portion. The ratio of the energies of the adaptive and fixed codebook excitations (including enhancement codebook) is computed for each subframe as:

$$\xi = \frac{E_p}{E_c}. \tag{1}$$

In order to reduce this ratio in case of unvoiced sounds, a "Wiener filter" characteristic is applied:

$$\xi_{post} = \xi \cdot \frac{\xi}{1+\xi}. \tag{2}$$

This leads to more consistent unvoiced sounds. The gains for the voiced and unvoiced contributions of exc(n) are determined using the following procedure. An intermediate voiced gain $g'_v$ is calculated by:

$$g'_v = \sqrt{\frac{\xi_{post}}{1+\xi_{post}}}, \tag{3}$$

which is slightly smoothed to obtain the final voiced gain $g_v$:

$$g_v = \sqrt{\frac{1}{2}(g'^2_v + g'^2_{v,old})}, \tag{4}$$

where $g'_{v,old}$ is the value of $g'_v$ of the preceding subframe.

To satisfy the constraint $g_v^2+g_{uv}^2=1$, the unvoiced gain is given by:

$$g_{uv}=\sqrt{1-g_v^2}. \tag{5}$$

The generation of a consistent pitch structure within the excitation signal exc(n) requires a good estimate of the fundamental pitch lag $t_0$ of the speech production process. Within Layer 1 of the bitstream, the integer and fractional pitch lag values $T_0$ and frac are available for the four 5 ms subframes of the current superframe. For each subframe, the estimation of $t_0$ is based on these parameters.

The aim of the G.729 encoder-side pitch search procedure is to find the pitch lag that minimizes the power of the LTP residual signal. That is, the LTP pitch lag is not necessarily identical with $t_0$, which is required for the concise reproduction of voiced speech components. The most typical deviations are pitch-doubling and pitch-halving errors. For example, the frequency corresponding to the LTP lag is a half or double that of the original fundamental speech frequency. Especially, pitch-doubling (or tripling, etc.) errors have to be strictly avoided. Thus, the following post-processing of the LTP lag information is used. First, the LTP pitch lag for an oversampled time-scale is reconstructed from $T_0$ and frac, and a bandwidth expansion factor of 2 is considered:

$$t_{LTP}=2\cdot(3\cdot T_0+\text{frac}) \tag{6}$$

The (integer) factor between the currently observed LTP lag $t_{LTP}$ and the post-processed pitch lag of the preceding subframe $t_{post,old}$ (see Equation 9) is calculated by:

$$f = \text{int}\left(\frac{t_{LTP}}{t_{post,old}} + 0.5\right). \tag{7}$$

If the factor f falls into the range 2, . . . , 4, a relative error is evaluated as:

$$e = 1 - \frac{t_{LTP}}{f \cdot t_{post,old}}. \tag{8}$$

If the magnitude of this relative error is below a threshold $\epsilon=0.1$, it is assumed that the current LTP lag is the result of a beginning pitch-doubling (-tripling, etc.) error phase. Thus, the pitch lag is corrected by dividing with the integer factor f, thereby producing a continuous pitch lag behavior with respect to the previous pitch lags:

$$t_{post} = \begin{cases} \text{int}\left(\frac{t_{LTP}}{f} + 0.5\right) & |e| < \varepsilon,\ f > 1,\ f < 5 \\ t_{LTP} & \text{otherwise,} \end{cases} \tag{9}$$

which is further smoothed as:

$$t_p = \frac{1}{2} \cdot (t_{post,old} + t_{post}) \tag{10}$$

Note that this moving average leads to a virtual precision enhancement from a resolution of ⅓ to ⅙ of a sample. Finally, the post-processed pitch lag $t_p$ is decomposed in integer and fractional parts:

$$t_{0,int} = \text{int}\left(\frac{t_p}{6}\right) \tag{11}$$

and $$t_{0,frac} = t_p - 6 \cdot t_{0,int}.$$

The voiced components 406, $s_{exc,v}(n)$, of the TDBWE excitation signal are represented as shaped and weighted glottal pulses. voiced components 406 $s_{exc,v}(n)$ are thus produced by overlap-add of single pulse contributions:

$$S_{exc,v}(n) = \sum_p g_{Pulse}^{[p]} \times P_{n_{Pulse,frac}^{[p]}}\left(n - n_{Pulse,int}^{[p]}\right), \tag{12}$$

where $n_{Pulse,int}^{[p]}$ is a pulse position, $$P_{n_{Pulse,frac}^{[p]}}\left(n - n_{pulse,int}^{[p]}\right)$$

is the pulse shape, and $g_{Pulse}^{[p]}$ is a gain factor for each pulse. These parameters are derived in the following. The post-processed pitch lag parameters $t_{0,int}$ and $t_{0,frac}$ determine the pulse spacing. Accordingly, the pulse positions may be expressed as:

$$n_{Pulse,int}^{[p]} = n_{Pulse,int}^{[p-1]} + t_{0,int} + \text{int}\left(\frac{n_{Pulse,frac}^{[p-1]} + t_{0,frac}}{6}\right), \tag{13}$$

wherein p is the pulse counter, i.e., $n_{Pulse,int}^{[p]}$ is the (integer) position of the current pulse, and $n_{Pulse,int}^{[p-1]}$ is the (integer) position of the previous pulse.

The fractional part of the pulse position may be expressed as:

$$n_{Pulse,frac}^{[p]} = n_{Pulse,frac}^{[p-1]} + t_{0,frac} - 6 \cdot \text{int}\left(\frac{n_{Pulse,frac}^{[p-1]} + t_{0,frac}}{6}\right). \quad (14)$$

The fractional part of the pulse position serves as an index for the pulse shape selection. The prototype pulse shapes $P_i(n)$ with i=0, . . . , 5 and n=0, . . . , 56 are taken from a lookup table as plotted in FIG. 5. These pulse shapes are designed such that a certain spectral shaping, for example, a smooth increase of the attenuation of the voiced excitation components towards higher frequencies, is incorporated and the full sub-sample resolution of the pitch lag information is utilized. Further, the crest factor of the excitation signal is significantly reduced and an improved subjective quality is obtained.

The gain factor $g_{Pulse}^{[p]}$ for the individual pulses is derived from the voiced gain parameter $g_v$ and from the pitch lag parameters:

$$g_{Pulse}^{[p]}=(2\cdot\text{even}(n_{Pulse,int}^{[p]})-1)\cdot g_v\cdot\sqrt{6t_{0,int}+t_{0,frac}}. \quad (15)$$

Therefore, it is ensured that increasing pulse spacing does not results in the decrease in the contained energy. The function even( ) returns 1 if the argument is an even integer number and 0 otherwise.

The unvoiced contribution 407, $s_{exc,uv}(n)$, is produced using the scaled output of a white noise generator:

$$s_{exc,uv}(n)=g_{uv}\cdot\text{random}(n), n=0, \ldots, 39. \quad (16)$$

Having the voiced and unvoiced contributions $s_{exc,v}(n)$ and $s_{exc,uv}(n)$, the final exc excitation signal 402, $s_{HB}^{exc}(n)$, is obtained by low-pass filtering of $$\text{exc}(n)=s_{exc,v}(n)+s_{exc,uv}(n)$$

The low-pass filter has a cut-off frequency of 3,000 Hz, and its implementation is identical with the pre-processing low-pass filter for the high band signal.

The shaping of the time envelope of the excitation signal $s_{HB}^{exc}(n)$ utilizes the decoded time envelope parameters $\hat{T}_{env}(i)$ with i=0, . . . , 15 to obtain a signal 403, $\hat{s}_{HB}^{T}(n)$, with a time envelope that is nearly identical to the time envelope of the encoder side HB signal $s_{HB}(n)$. This is achieved by a simple scalar multiplication of a gain function $g_T(n)$ with the excitation signal $s_{HB}^{exc}(n)$. In order to determine the gain function $g_T(n)$, the excitation signal $s_{HB}^{exc}(n)$ is segmented and analyzed in the same manner as described for the parameter extraction in the encoder. The obtained analysis results from $s_{HB}^{exc}(n)$ are, again, time envelope parameters $\tilde{T}_{env}(i)$ with i=0, . . . , 15. They describe the observed time envelope of $s_{HB}^{exc}(n)$. Then, a preliminary gain factor is calculated by comparing $\hat{T}_{env}(i)$ with $\tilde{T}_{env}(i)$. For each signal segment with index i=0, . . . , 15, these gain factors are interpolated using a "flat-top" Hanning window. This interpolation procedure finally yields the desired gain function.

The decoded frequency envelope parameters $\hat{F}_{env}(j)$ with j=0, . . . , 11 are representative for the second 10 ms frame within the 20 ms superframe. The first 10 ms frame is covered by parameter interpolation between the current parameter set and the parameter set from the preceding superframe. The superframe of 403, $\hat{s}_{HB}^{T}(n)$, is analyzed twice per superframe. This is done for the first (l=1) and for the second (l=2) 10 ms frame within the current superframe and yields two observed frequency envelope parameter sets $\tilde{F}_{env,l}(j)$ with j=0, . . . , 11 and frame index l=1, 2. Now, a correction gain factor per sub-band is determined for the first frame and for the second frame by comparing the decoded frequency envelope parameters $\hat{F}_{env}(j)$ with the observed frequency envelope parameter sets $\tilde{F}_{env,l}(j)$. These gains control the channels of a filterbank equalizer. The filterbank equalizer is designed such that its individual channels match the sub-band division. It is defined by its filter impulse responses and a complementary high-pass contribution.

The signal 404, $\hat{s}_{HB}^{F}(n)$ is obtained by shaping both the desired time and frequency envelopes on the excitation signal $s_{HB}^{exc}(n)$ (generated from parameters estimated in lower-band by the CELP decoder). There is in general no coupling between this excitation and the related envelope shapes $\hat{T}_{env}(i)$ and $\hat{F}_{env}(j)$. As a result, some clicks may occur in the signal $\hat{s}_{HB}^{F}(n)$. To attenuate these artifacts, an adaptive amplitude compression is applied to $\hat{s}_{HB}^{F}$. Each sample of $\hat{s}_{HB}^{F}(n)$ of the i-th 1.25 ms segment is compared to the decoded time envelope $\hat{T}_{env}(i)$, and the amplitude of $\hat{s}_{HB}^{F}(n)$ is compressed in order to attenuate large deviations from this envelope. The signal after this post-processing is named as 405, $\hat{s}_{HB}^{bwe}(n)$.

SUMMARY OF THE INVENTION

Various embodiments of the present invention are generally related to speech/audio coding, and particular embodiments are related to low bit rate speech/audio transform coding such as BandWidth Extension (BWE). For example, concepts can be applied to ITU-T G.729.1 and G.718 super-wideband extension involving the filling of 0 bit subbands and lost subbands Adaptive and selective BWE methods are introduced to generate or compose extended spectral fine structure or extended subbands by using available information at decoder, based on signal periodicity, type of fast/slow changing signal, and/or type of harmonic/non-harmonic subband. In particular, a method of receiving an audio signal includes measuring a periodicity of the audio signal to determine a checked periodicity; at least one best available subband is determined; at least one extended subband is composed, wherein the composing includes reducing a ratio of composed harmonic components to composed noise components if the checked periodicity is lower than a threshold, and scaling a magnitude of the at least one extended subband based on a spectral envelope on the audio signal.

In one embodiment, a method of bandwidth extension (BWE) adaptively and selectively generates an extended fine spectral structure or extended high band by using available information in different possible ways to maximize the perceptual quality. The periodicity of the related signal is checked. The best available subbands or the low band to the extended subbands or the extended high band are copied when the periodicity is high enough. The extended subbands or the extended high band are composed while relatively reducing the more harmonic component or increasing the noisier component when the checked periodicity is lower than the certain threshold. The magnitude of each extended subband is scaled based on the transmitted spectral envelope.

In one example, the improved BWE can be used to fill 0 bit subbands where fine spectral structure information of each 0 bit subband is not transmitted due to its relatively low energy in high band area.

In another example, the improved BWE can be used to recover subbands lost during transmission.

In another example, when ITU-T G.729.1 codec is used as the core of the new extended codec, the improved BWE can be used to replace the existing TDBWE in such a way of generating the extended fine spectral structure: $S_{BWE}(k)=g_h\cdot\hat{S}_{LB}^{celp,w}(k)+g_n\cdot\hat{D}_{LB}^{w}(k)$, especially in filling 0 bit subbands, wherein $\hat{S}_{LB}^{celp,w}(k)$ is the more harmonic component and $\hat{D}_{LB}^{w}(k)$ is the noisier component; $g_h$ and $g_n$ control the relative energy between $\hat{S}_{LB}^{celp,w}(k)$ component and $\hat{D}_{LB}^{w}(k)$ component.

In another example, if the periodicity parameter $\overline{G}_p \leqq 0.5$, $g_h=1-0.9\ (0.5-\overline{G}_p)/0.5$ and $g_n=1$; otherwise, $g_h=1$ and $g_n=1$; $\overline{G}_p$ is the smoothed one of $G_p=E_p/(E_c+E_p)$, $0<G_p<1$; $E_c$ and $E_p$ are respectively the energy of the CELP fixed codebook contributions and the energy of the CELP adaptive codebook contribution.

In another embodiment, a method of BWE adaptively and selectively generating the extended fine spectral structure or extended high band by using the available information in different possible ways to maximize the perceptual quality is disclosed. It is detected whether the related signal is a fast changing signal or a slow changing signal. The synchronization is kept as high priority between high band signal and low band signal if the high band signal is the fast changing signal. Fine spectrum quality of extended high band is enhanced as high priority if the high band signal is the slow changing signal.

In one example, the fast changing signal includes the energy attack signal and speech signal. The slow changing signal includes most music signals. Most music signals with the harmonic spectrum belong to the slow changing signal.

In another embodiment, the BWE adaptively and selectively generates the extended fine spectral structure or extended high band by using the available information in different possible ways to maximize the perceptual quality. The available low band is divided into two or more subbands. It is checked if each available subband is harmonic enough. The method includes only selecting harmonic available subbands used to further compose the extended high band.

In one example, the harmonic subband can be found or judged by measuring the periodicity of the corresponding time domain signal or by estimating the spectral regularity and the spectral sharpness.

In another example, the composition or generation of the extended high band can be realized through using the QMF filterbanks or simply and repeatedly copying available harmonic subbands to the extended high band.

BRIEF DESCRIPTION OF THE DRAWINGS

For a more complete understanding of the present invention, and the advantages thereof, reference is now made to the following descriptions taken in conjunction with the accompanying drawing, in which.

DETAILED DESCRIPTION OF ILLUSTRATIVE EMBODIMENTS

Figure 1:
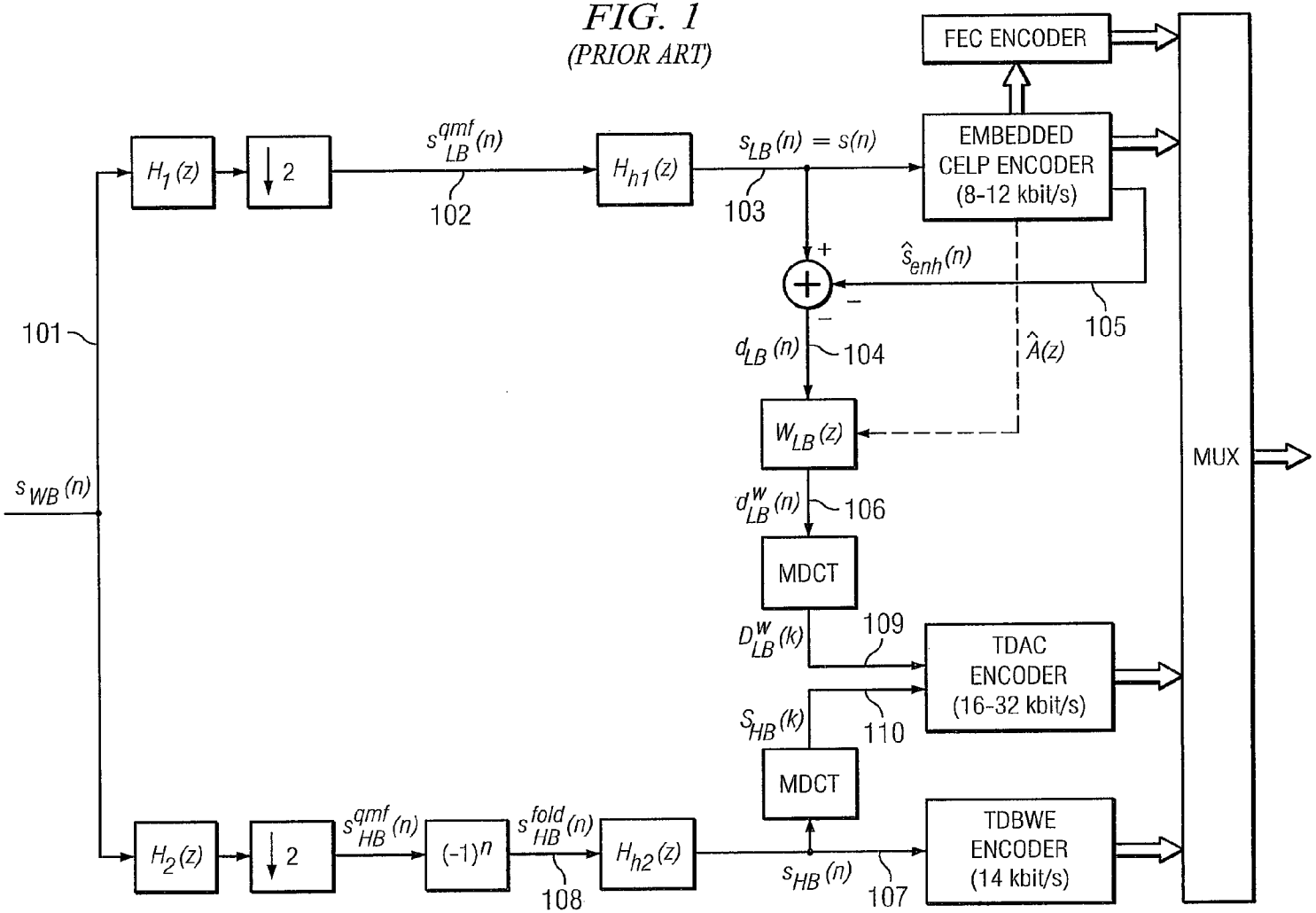
FIG. 1 (PRIOR ART)
FIG. 1 illustrates a high-level block diagram of the ITU-T G.729.1 encoder.
Figure 2:
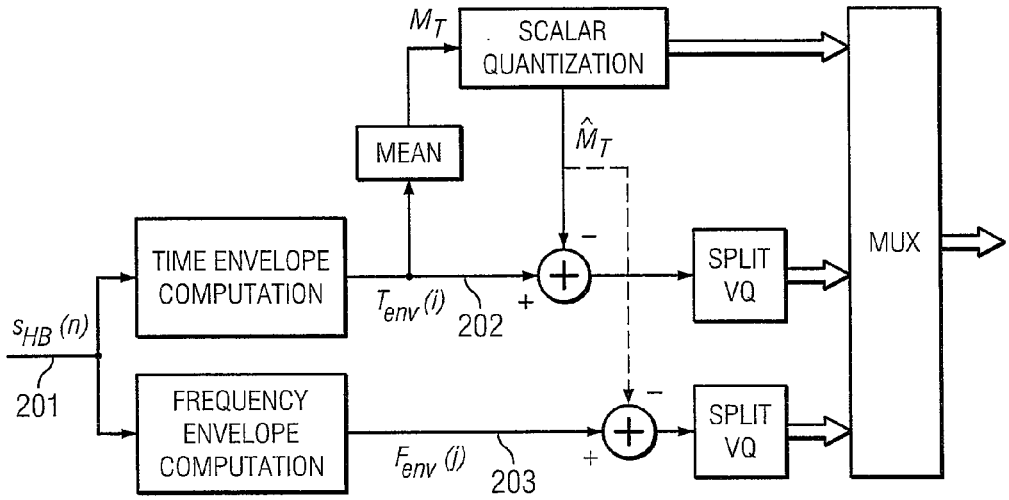
FIG. 2 (PRIOR ART)
FIG. 2 illustrates a high-level block diagram of the TDBWE encoder for the ITU-T G.729.1.

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The making and using of the embodiments of the disclosure are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

In transform coding, a concept of BandWidth Extension (BWE) is widely used. The similar concept sometimes is also called High Band Extension (HBE), SubBand Replica (SBR) or Spectral Band Replication (SBR). In the BWE algorithm, extended spectral fine structure is often generated without spending any bit. Embodiments of the invention use a concept of adaptively and selectively generating or composing extended fine spectral structure or extended subbands by using available information in different possible ways to maximize perceptual quality, where more harmonic components and less harmonic components can be adaptively mixed during the generation of extended fine spectral structure. The adaptive and selective methods are based on the characteristics of high periodicity/low periodicity, fast changing signal/slow changing signal, and/or harmonic subband/non-harmonic subband. In particular embodiments, the invention can be advantageously used when ITU G.729.1 is in the core layer for a scalable super-wideband codec. The concept can be used to improve or replace the TDWBE in the ITU G729.1 to fill 0 bit subbands or recover lost subbands; it may be also employed for the SWB extension.

Examples to generate [4,000 Hz, 7,000 Hz] spectral fine structure based on information from [0, 4,000 Hz] and produce [8,000 Hz, 14,000 Hz] spectral fine structure based on information from [0, 8,000 Hz] will be given.

In low bit rate transform coding technology, a concept of BandWidth Extension (BWE) has been widely used. The similar or same concept sometimes is also called High Band Extension (HBE), SubBand Replica (SBR) or Spectral Band Replication (SBR). Although the name could be different, they all have the similar or same meaning of encoding/decoding some frequency sub-bands (usually high bands) with little budget of bit rate (even zero budget of bit rate) or significantly lower bit rate than normal encoding/decoding approach. Precise description of spectral fine structure needs a lot of bits, which becomes not realistic for any BWE algorithm. There are several ways for BWE algorithm to generate the spectral fine structure.

As already mentioned, there are two kind of basic BWE algorithms. One basic BWE algorithm does not spend any bits. Another basic BWE algorithm spends little bits mainly to code spectral envelope and temporal envelope (temporal envelope coding is optional). No matter which BWE algorithm is used, fine spectral structure (representing excitation) is usually generated in some way by taking some information from low band without spending bits, such as TDBWE (in G729.1) which generates excitation by using pitch information from CELP. The BWE algorithm often constructs high band signal by using generated fine spectral structure, transmitted spectral envelope information, and transmitting time domain envelope information (if available). Aspects of this invention relate to spectral fine structure generation (excitation generation).

Embodiments of the present invention of adaptively and selectively generate extended subbands by using available subbands, and adaptively mix extended subbands with noise to compose generated fine spectral structure or generated excitation. An exemplary embodiment, for example, generates the spectral fine structure of [4,000 Hz, 7,000 Hz] based on information from [0, 4,000 Hz] and produces the spectral fine structure of [8,000 Hz, 14,000 Hz] based on information from [0, 8,000 Hz]. In particular, the embodiments can be advantageously used when ITU G.729.1 is in the core layer for a scalable super-wideband codec. The concept can be used to improve or replace the TDWBE in the ITU G729.1, such as filling 0 bit subbands or recovering lost subbands; it may also be employed for the SWB extension.

The TDBWE in G729.1 aims to construct the fine spectral structure of the extended subbands from 4 kHz to 7 kHz. The proposed embodiments, however, may be applied to wider bands than the TDBWE algorithm. Although the embodiments are not limited to specific extended subbands, as examples to explain the invention, the extended subbands will be defined in the high bands [8 kHz, 14 kHz] or [3 kHz, 7 kHz] assuming that the low bands [0, 8 kHz] or [0, 4 kHz] are already encoded and transmitted to decoder. In the exemplary embodiments, the sampling rate of the original input signal is 32 k Hz (it can also be 16 kHz). The signal at the sampling rate of 32 kHz covering [0, 16 kHz] bandwidth is called super-wideband (SWB) signal. The down-sampled signal covering [0, 8 kHz] bandwidth is referred to as a wideband (WB) signal. The further down-sampled signal covering [0, 4 kHz] bandwidth is referred to as a narrowband (NB) signal. The examples will show how to construct the extended subbands covering [8 kHz, 14 kHz] or [3 kHz, 7 kHz] by using available NB or WB signals (NB or WB spectrum). The similar or same ways can be also employed to extend low band (LB) spectrum to any high band (HB) area if LB is available while HB is not available at the decoder side. Therefore, the embodiments may function to improve or replace TDBWE for the ITU-T G729.1 when the extended subbands are located from 4 kHz to 7 kHz, for example.

In G729.1, the harmonic portion 406, $s_{exc,v}(n)$, is artificially or mathematically generated according to the parameters (pitch and pitch gain) from the CELP coder, which encodes the NB signal. This model of TDBWE assumes the input signal is human voice so that a series of shaped pulses are used to generate the harmonic portion. This model could fail for music signal mainly due to the following reasons. For a music signal, the harmonic structure could be irregular, which means that the harmonics could be unequally spaced in spectrum while TDBWE assumes regular harmonics that are equally spaced in the spectrum.

Figure 7:
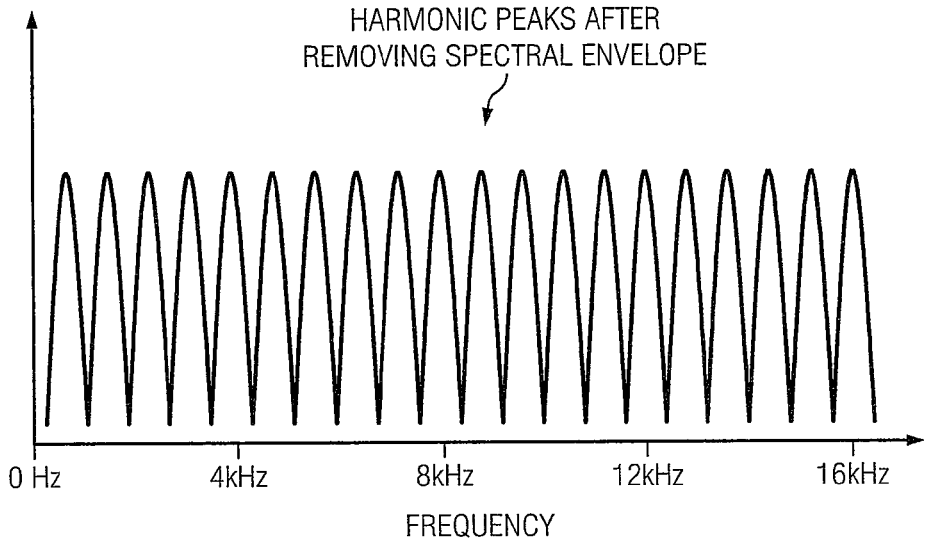
FIG. 7 shows an example of a harmonic spectrum for super-wideband signal.
Figure 8:
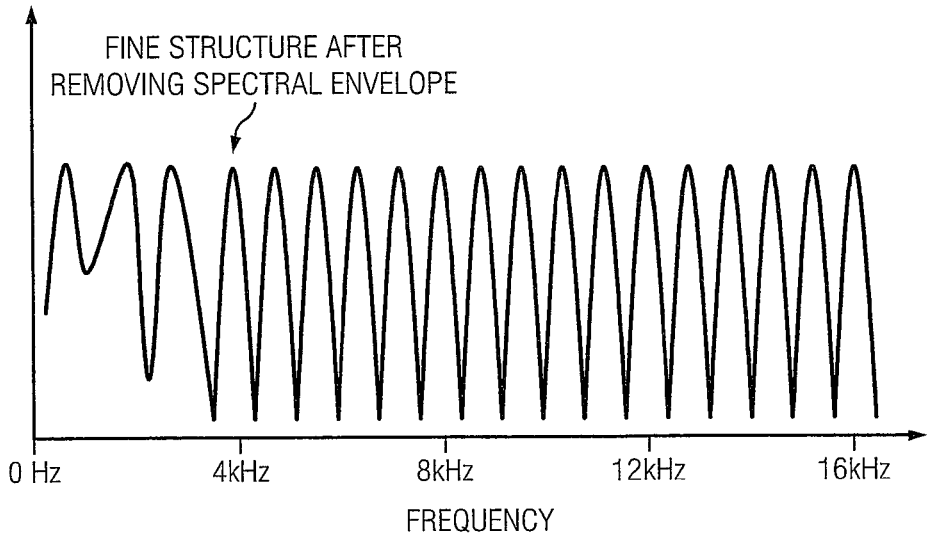
FIG. 8 shows an example of a irregular harmonic spectrum for super-wideband signal.

FIG. 7 and FIG. 8 show examples of a regular harmonic spectrum and an irregular harmonic spectrum for super-wideband signal. For the convenience, the figures are drawn in an ideal way, while real signal may contain some noise components. The irregular harmonics could result in a wrong pitch lag estimation. Even if the music harmonics are equally spaced in spectrum, the pitch lag (corresponding to the distance of two neighboring harmonics) could be out of range defined for speech signal in G. 729.1. For a music signal, another case that occasionally happens is that the narrowband (0-4 kHz) is not harmonic, while the high band is harmonic. In this case, the information extracted from the narrowband cannot be used to generate the high band fine spectral structure. Harmonic subbands can be found or judged by measuring the periodicity of the corresponding time domain signal or by estimating the spectral regularity and spectral sharpness (peak to average ratio).

In order to make sure the proposed concept can be used for general signals with different frequency bandwidths, including speech and music, the notation here will be slightly different from the G.729.1. The generated fine spectral structure is noted as a combination of harmonic-like component and noise-like component:

$$S_{BWE}(k)=g_h \cdot S_h(k)+g_n \cdot S_n(k), \tag{17}$$

In equation (17), Sh(k) contains harmonics, and Sn(k) is a random noise. gh and gn are the gains to control the ratio between the harmonic-like component and noise-like component. These two gains may be subband dependent. The gain control is also called spectral sharpness control. When $g_n$ is zero, $S_{BWE}(k)=S_h(k)$. The embodiments describes selective and adaptive generation of the harmonic-like component of $S_h(k)$, which is an important portion to the successful construction of the extended fine spectral structure. If the generated excitation is expressed in time domain, it may be expressed as, $$s_{BWE}(n)=g_h \cdot s_h(n)+g_n \cdot s_n(n), \tag{18}$$

where $s_h(n)$ contains harmonics.

Figure 6:
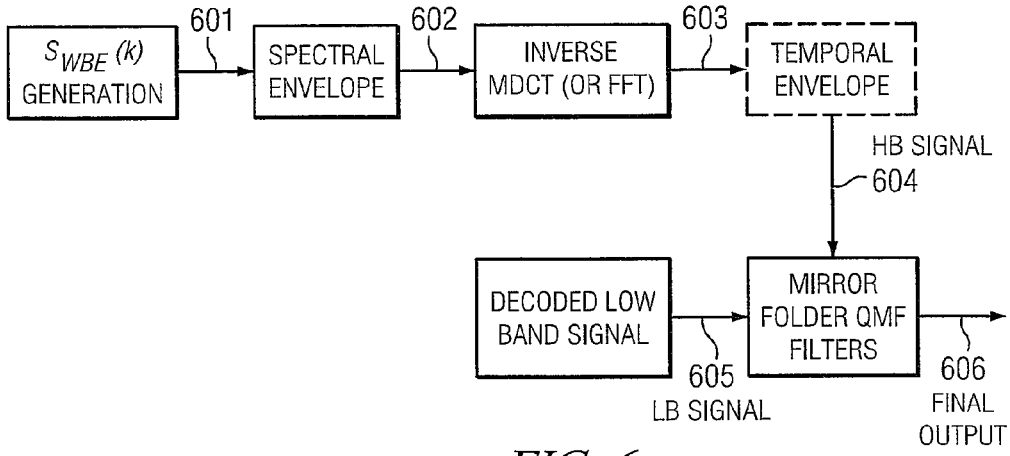
FIG. 6 shows a basic principle of BWE which is related to the invention.

FIG. 6 shows the general principle of the BWE. The temporal envelope coding block in FIG. 6 is dashed since it can be also applied at different location or it may be simply omitted. In other words, equation (18) can be generated first; and then the temporal envelope shaping is applied in time domain. The temporally shaped signal is further transformed into frequency domain to get 601, $S_{WBE}(k)$, to apply the spectral envelope. If 601, $S_{WBE}(k)$, is directly generated in frequency domain as in equation (17), the temporal envelope shaping may be applied afterword. Note that the absolute magnitudes of $\{S_{WBE}(k)\}$ in different subbands are not important as the final spectral envelope will be applied later according to the transmitted information. In FIG. 6, 602 is the spectrum after the spectral envelope is applied; 603 is the time domain signal from inverse-transformation of 602; and 604 is the final extended HB signal. Both the LB signal 605 and the HB signal 604 are up-sampled and combined with QMF filters to form the final output 606.

In the following illustrative embodiments, selective and/or adaptive ways for generating the extended spectrum $\{S_{WBE}(k)\}$ are described. For easy understanding of the embodiments, several exemplary embodiments will be given. The first exemplary embodiment provides a method of BWE adaptively and selectively generating extended fine spectral structure or extended high band by using available information in different possible ways to maximize perceptual quality, which comprises the steps of: checking periodicity of related signal; copying best available subbands or low band to extended subbands or extended high band when the periodicity is high enough; composing extended subbands or extended high band while relatively reducing the more harmonic component or increasing the noisier (less harmonic) component when the checked periodicity is lower than certain threshold; and scaling the magnitude of each extended subband based on transmitted spectral envelope.

In the first exemplary embodiment, the TDBWE in G.729.1 is replaced in order to achieve more robust quality. The principle of the TDBWE has been explained in the background section. The TDBWE has several functions in G.729.1. The first function is to produce a 14 kbps output layer. The second function is to fill so called 0 bit subbands in [4 kHz, 7 kHz] where the fine spectral structures of some low energy subbands are not encoded/transmitted from encoder. The last function is to generate [4 kHz, 7 kHz] spectrum when the frame packet is lost during transmission. The 14 kbps output layer cannot be modified anymore since it is already standardized. The other functions can be modified when using G.729.1 as the core codec to have more extended super-wideband output layers. As illustrated in the background section, in G.729.1 codec, the [0, 4 kHz] NB output can be expressed in time domain as:

$$\hat{s}_{LB}(n)=\hat{s}_{LB}^{celp}(n)+\hat{d}_{LB}(n), \tag{19}$$

or, $$\hat{s}_{LB}(n)=\hat{s}_{LB}^{celp}(n)+\hat{d}_{LB}^{echo}(n), \tag{20}$$

In weighted domain, it becomes, $$\hat{s}_{LB}^{w}(n)=\hat{s}_{LB}^{celp,w}(n)+\hat{d}_{LB}^{w}(n), \tag{21}$$

In frequency domain, equation (21) is written as, $$\hat{S}_{LB}^{w}(k)=\hat{S}_{LB}^{celp,w}(k)+\hat{D}_{LB}^{w}(k), \tag{22}$$

where $\hat{S}_{LB}^{celp,w}(k)$ comes from CELP codec output; and $\hat{D}_{LB}^{w}(k)$ is from MDCT codec output, which is used to compensate for the error signal between the original reference signal and the CELP codec output so that it is more noise-like. We can name here $\hat{S}_{LB}^{celp,w}(k)$ as the composed harmonic components and $\hat{D}_{LB}^{w}(k)$ as the composed noise components. When the spectral fine structures of some subbands (0 bit subbands) in [4 kHz, 7 kHz] are not available at decoder, these subbands can be filled by using the NB information as follows:

(1) Check the periodicity of the signal. The periodicity can be represented by the normalized voicing factor noted as $G_p=E_p/(E_c+E_p)$, $0<G_p1$, obtained from the CELP algorithm. The smoothed voicing factor is $\overline{G}_p$. $E_c$ and $E_p$ are the energy of the fixed codebook contributions and the energy of the adaptive codebook contribution, respectively, as explained in the background section.

(2) When the periodicity is high enough (for example, when $\overline{G}_p>0.5$), the spectrum coefficients $\{\hat{S}_{LB}^{w}(k)\}$ in [0, 3 kHz] of Equation (22) is simply copied to [4 kHz, 7 kHz], which means $S_{BWE}(k)=\hat{S}_{LB}^{w}(k)$.

(3) When the periodicity is low (let's say $\overline{G}_p\leqq 0.5$), the extended spectrum is set to $S_{BWE}(k)=g_h\cdot\hat{S}_{LB}^{celp,w}(k)+g_n\cdot\hat{D}_{LB}^{w}(k)$, where $g_h=1-0.9(0.5-\overline{G}_p)/0.5$ and $g_h=1$. $\hat{D}_{LB}^{w}(k)$ is viewed as noise-like component to save the complexity and keep the synchronization between the low band signal and the extended high band signal. The above example keeps the synchronization and also follows the periodicity of the signal.

The following examples are more complicated. Assume WB [0, 8 kHz] is available at decoder and the SWB [8 kHz, 14 kHz] needs to be extended from WB [0, 8 kHz]. One of the solutions could be the time domain construction of the extended excitation as described in G729.1. However, this solution has potential problems for music signals as already explained above. Another possible solution is to simply copy the spectrum of [0, 6 kHz] to [8 kHz, 14 kHz] area. Unfortunately, relying on this solution could also result in problems as explained later. In case that the G.729.1 is in the core layer of WB [0, 8 kHz] portion, the NB is mainly coded with the time domain CELP coder and there is no complete spectrum of WB [0, 6 kHz] available at decoder side so that the complete spectrum of WB [0, 6 kHz] needs to be computed by transforming the decoded time domain output signal into frequency domain (or MDCT domain). The transformation from time domain to frequency domain is necessary because the proper spectral envelope needs to be applied, and probably, a subband dependent gain control (also called spectral sharpness control) needs to be applied. Consequently, this transformation itself causes a time delay (typically 20 ms) due to the overlap-add required by the MDCT transformation.

A delayed signal in SWB could severely influence the perceptual quality if the input original signal is a fast changing signal such as a castanet music signal, or a fast changing speech signal. Another case which occasionally happens for a music signal is that the NB is not harmonic while the high band is harmonic. In this case, the simple copy of [0, 6 kHz] to [8 kHz, 14 kHz] cannot achieve the desired quality. Fast changing signals include energy attack signal and speech signals. Slow changing signals includes most music signals, and most music signals with harmonic spectrum belong to slow changing signal.

To help understanding of different situations, FIG. 7 through FIG. 11 list some typical examples of spectra where the spectral envelopes have been removed. Generation or composition of extended high band can be realized through using QMF filterbanks or simply and repeatedly copying available subbands to extended high bands. The examples of selectively generating or composing extended subbands are provided as follows.

Figure 10:
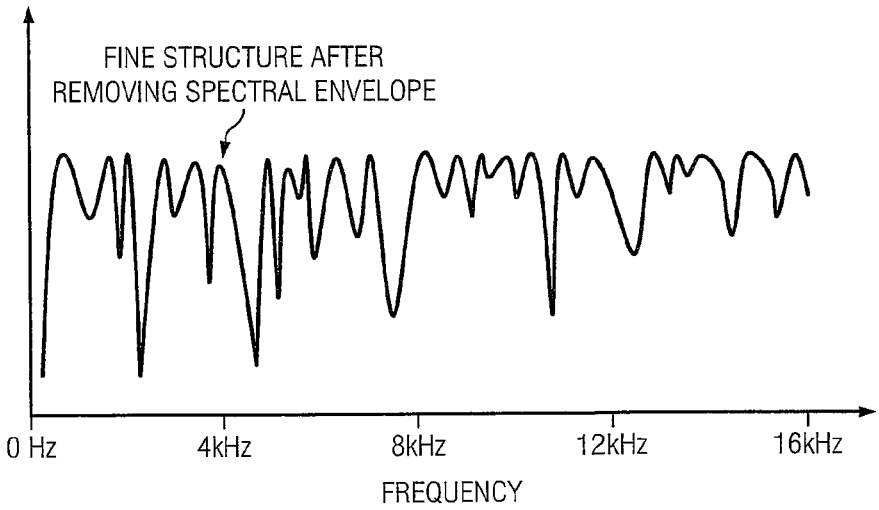
FIG. 10 shows an example of a spectrum for super-wideband signal.

When the input original signal is a fast changing such as a speech signal, and/or when the input original signal contains an energy attack such as a castanet music signal, the synchronization between the low bands and the extended high bands is the highest priority. The original spectrum of the fast changing signal may be similar to the examples shown in FIG. 7 and FIG. 11. The original spectrum of energy attack signal may be similar to what is shown in FIG. 10. A method of BWE may include adaptively and selectively generating an extended fine spectral structure or an extended high band by using available information in different possible ways to maximize the perceptual quality. The method may include the steps of: detecting if related signal is fast changing signal or slow changing signal; and keeping synchronization as high priority between high band signal and low band signal if high band signal is fast changing signal. The processing of the case of slow changing signal, which processing step (as a high priority) results in an enhancement in the fine spectrum quality of extended high band. In order to achieve the synchronization, there are several possibilities in case that the G729.1 is served as the core layer of a super-wideband codec.

Figure 3:
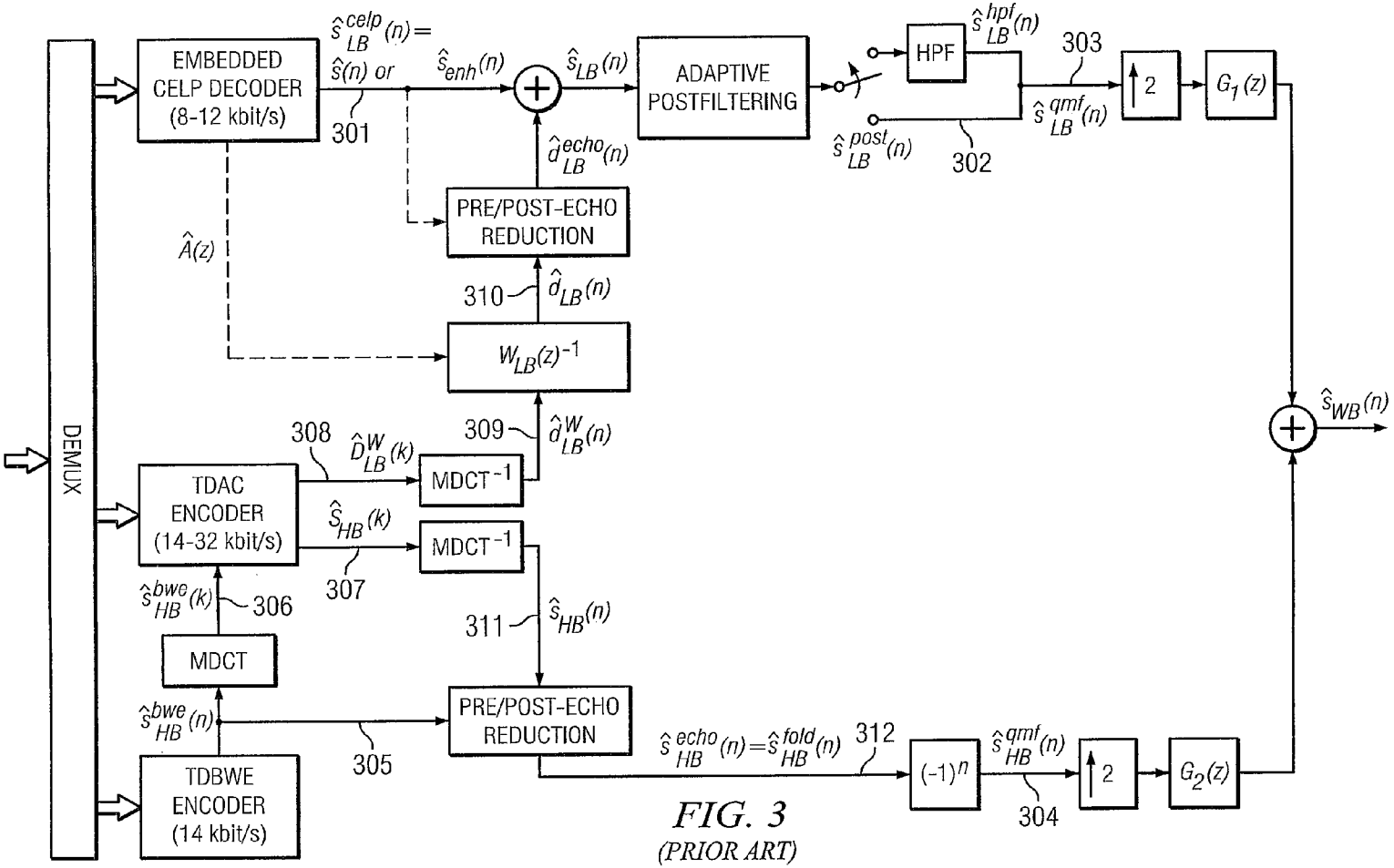
FIG. 3 (PRIOR ART)
FIG. 3 illustrates a high-level block diagram of the ITU-T G.729.1 decoder.
Figure 4:
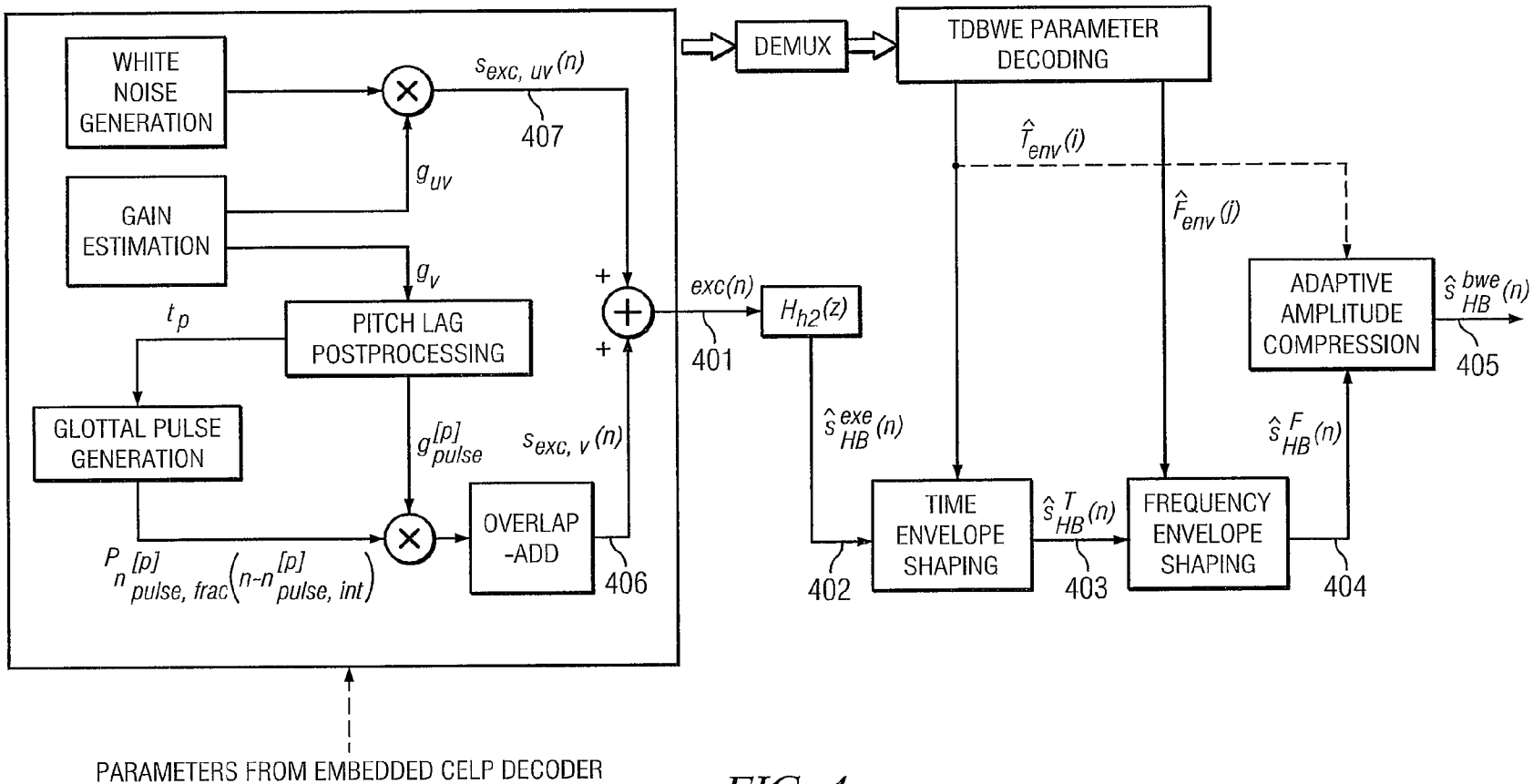
FIG. 4 (PRIOR ART)
FIG. 4 illustrates a high-level block diagram of the TDBWE decoder for G.729.1.
Figure 5:
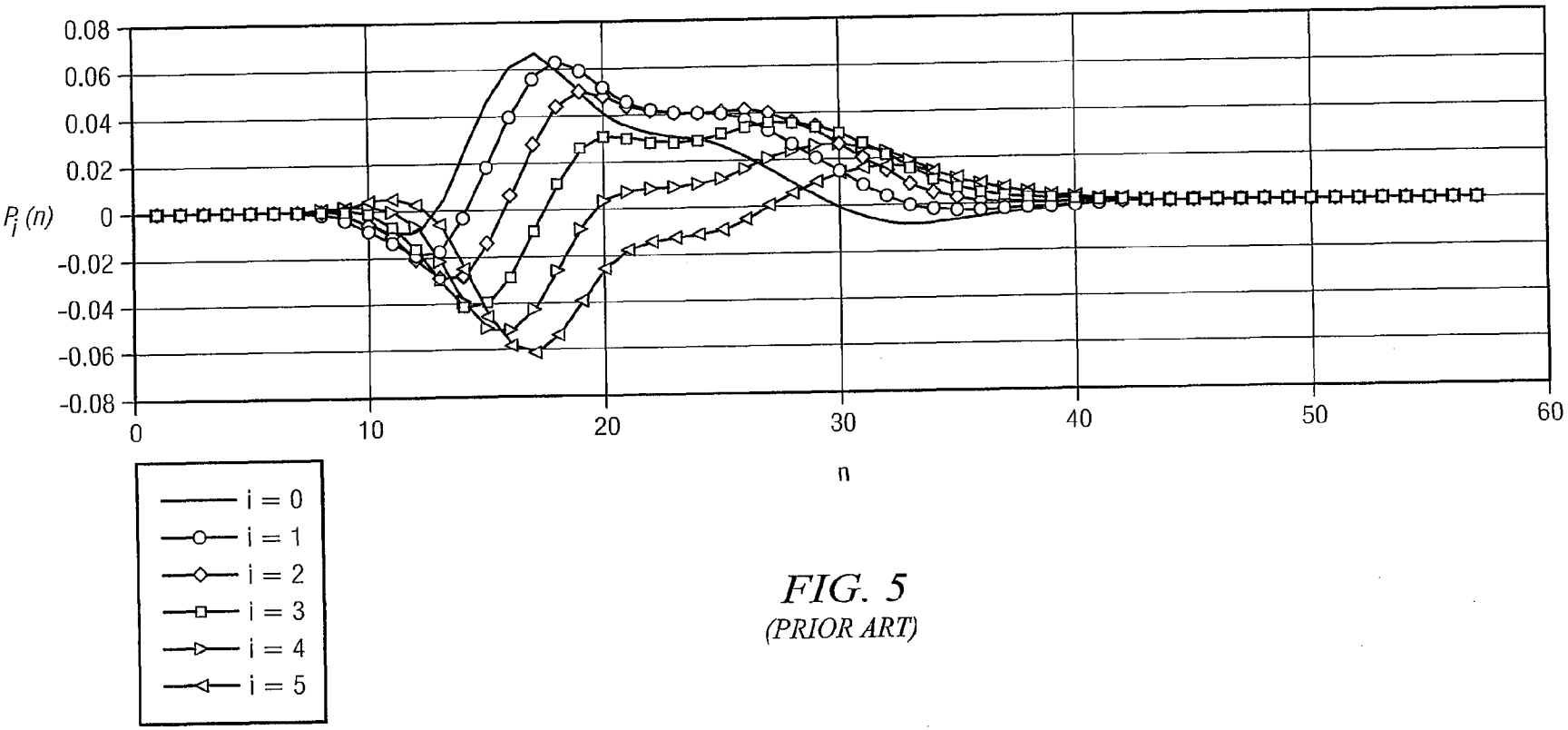
FIG. 5 (PRIOR ART)
FIG. 5 illustrates a pulse shape lookup table for the TDBWE.

(1) The CELP output (NB signal) (see FIG. 3) without the MDCT enhancement layer in NB, $\hat{s}_{LB}^{celp}(n)$, is spectrally folded by $(-1)^n$. The folded signal is then combined with itself, $s_{LB}^{celp}(n)$, and upsampled in the QMF synthesis filterbanks to form a WB signal. The resulting WB signal is further transformed into frequency domain to get the harmonic component $S_h(k)$, which will be used to construct $S_{WBE}(k)$ in equation (17). The inverse MDCT in FIG. 6 causes a 20 ms delay. However, the CELP output is advanced 20 ms so that the final extended high bands are synchronized with low bands in time domain. The above steps of processing actually achieve the goal that the harmonic component in [0, 4 kHz] is copied to [8 kHz, 12 kHz] and [0, 4 kHz] is also copied to [12 kHz, 16 kHz]. Because [14 kHz, 16 kHz] is not needed, it can be simply muted (set to zero) in frequency domain.

(2) If the MDCT enhancement layer in NB needs to be considered, the CELP output $\hat{s}_{LB}^{celp}(n)$ can be filtered by the same weighting filter used for the MDCT enhancement layer of NB; then transformed into MDCT domain, $\hat{S}_{LB}^{celp,w}(k)$, and added with the MDCT enhancement layer $\hat{D}_{LB}^{w}{}_{B}(k)$. The summed spectrum $\hat{S}LB^{w}(k)=\hat{S}_{LB}^{celp,w}(k)+\hat{D}_{LB}^{w}(k)$ can be copied directly to [8 kHz, 12 kHz] and [12 kHz, 16 kHz] through several steps including the procedure of FIG. 6. This type of generation of the extended harmonic component also keeps the synchronization between the low band (WB) and high band (SWB). However, the spectrum coefficients $S_h(k)$ are obtained by transforming a signal at the sampling rate of 8 kHz (not the 16 kHz).

(3) If the spectrum region [4 kHz, 8 kHz] is more harmonic (see FIG. 8) than the region [0, 4 kHz] and [4 kHz, 8 kHz] is well coded in terms of its high energy, the MDCT spectrum of [4 kHz, 8 kHz] can be directly copied to [8 k, 12 kHz] and [12 k, 16 kHz]. Again, this type of generation of the extended harmonic component keeps the synchronization between the low band (WB) and high band (SWB); but the spectrum coefficients $S_h(k)$ are obtained by transforming a signal at the sampling rate of 8 kHz (not the 16 kHz).

(4) If both [0.4 kHz] and [4 kHz, 8 kHz] are harmonic enough, and they all are coded well, the spectrum $S_{LB}^{w}(k)$ of [0, 4 kHz] defined above can be copied to [8 k, 12 kHz]; meanwhile, [4 kHz, 8 kHz] is copied to [12 kHz, 16 kHz]. The similar advantage and disadvantage as explained above exist for this solution.

When the input original signal is slowly changed and/or when the whole WB signal is harmonic, the high quality of spectrum is more important than the delay issue. A method of BWE then may include adaptively and selectively generating an extended fine spectral structure or an extended high band by using available information in different possible ways to maximize the perceptual quality. The method may comprise the steps of: detecting if related signal is fast changing signal or slow changing signal; and enhancing fine spectrum quality of extended high band as a high priority if a high band signal is a slow changing signal. Processing of the case of fast changing signal has been described in preceding paragraphs, and hence is not repeated herein.

Figure 11:
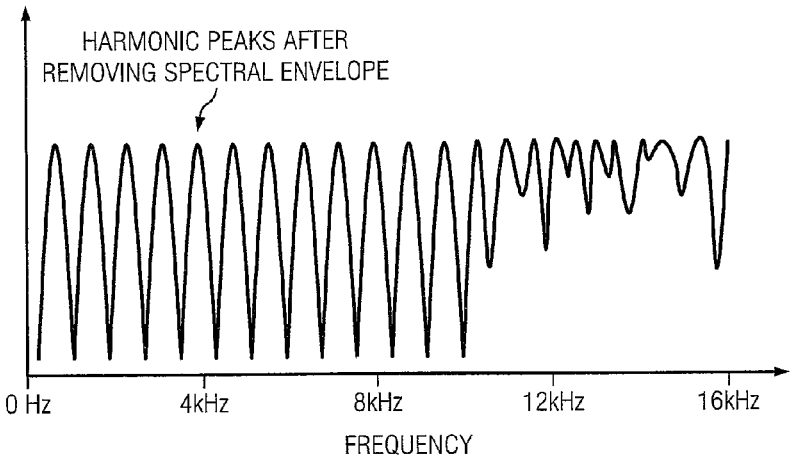
FIG. 11 shows an example of a spectrum for super-wideband signal.

So, the WB final output $\hat{s}_{WB}(n)$ from the G729.1 decoder should be transformed into MDCT domain; then copied to $S_h(k)$. After processed by the mirror folder and QMF filters shown in FIG. 6, the spectrum range of $S_h(k)$ will be moved up to [8 k, 16 kHz]. Although the extended signal will have 20 ms delay due to the MDCT transformation of the final WB output, the overall quality could still be better than the above solutions of keeping the synchronization. FIG. 7 and FIG. 11 show some examples.

When the input original signal is slowly changed and/or when the NB signal is not harmonic enough while [4 kHz, 8 kHz] is harmonic enough, the high quality of spectrum is still more important than the delay issue. A method of BWE may thus include adaptively and selectively generating extended fine spectral structure or extended high band by using available information in different possible ways to maximize the perceptual quality. The method comprises the steps of: dividing available low band into two or more subbands; checking if each available subband is harmonic enough; and only selecting harmonic available subbands used to further compose extended high band. In the current example, it is assumed that [4 kHz, 8 kHz] is harmonic while [0.4 kHz] is not harmonic.

The decoded time domain output signal $\hat{s}_{HB}^{qmf}(n)$ can be spectrally mirror-folded first; the folded signal is then combined with itself $\hat{s}_{HB}^{qmf}(n)$, and upsampled in the QMF synthesis filterbanks to form a WB signal. The resulting WB signal is further transformed into frequency domain to get the harmonic component $S_h(k)$. After the processing of another mirror folder and QMF filters shown in FIG. 6, the spectrum range of $S_h(k)$ will be moved up to [8 k, 16 kHz]. Although the extended signal will have 20 ms delay due to the MDCT transformation of the decoded output of [4 kHz, 8 kHz], the overall quality could be still better than the solutions of keeping the synchronization. FIG. 8 shows an example.

When the input original signal is slowly changed and/or when the NB signal is harmonic enough while [4 kHz, 8 kHz] are not harmonic enough, the high quality of spectrum is still more important than the delay issue. Accordingly, a method of BWE may include adaptively and selectively generating extended fine spectral structure or extended high band by using available information in different possible ways to maximize the perceptual quality. The method may include the steps of: dividing available low band into two or more subbands; checking if each available subband is harmonic enough; and only selecting harmonic available subbands used to further compose extended high band. The current example assumes that [0.4 kHz] is harmonic while [4 kHz, 8 kHz] is not harmonic.

Figure 9:
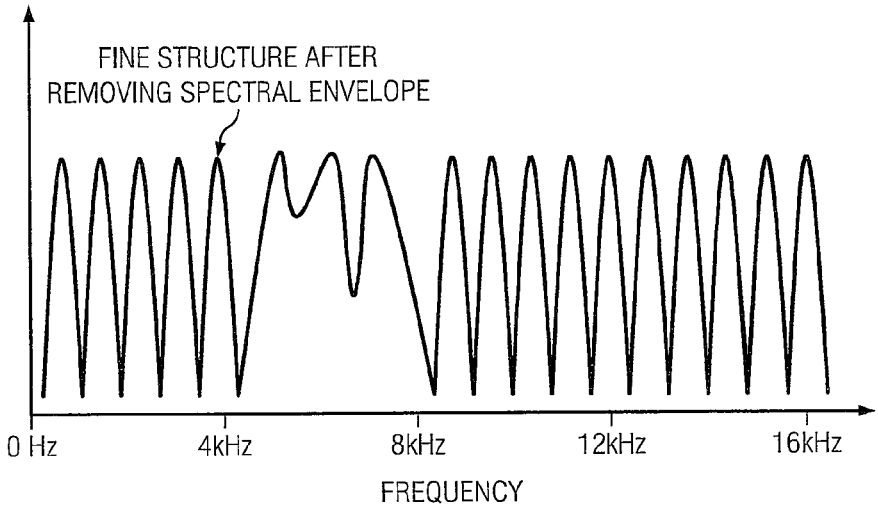
FIG. 9 shows an example of a spectrum for super-wideband signal.

The decoded NB time domain output signal $\hat{s}_{LB}^{qmf}(n)$ can be spectrally mirror-folded; and then combined with itself $\hat{s}_{LB}^{qmf}(n)$, and upsampled in the QMF synthesis filterbanks to form a WB signal. The resulting WB signal is further transformed into frequency domain to get the harmonic component $S_h(k)$. After the processing of another mirror folder and QMF filters shown in FIG. 6, the spectrum range of $S_h(k)$ will be moved up to [8 k, 16 kHz]. Although the extended signal will have 20 ms delay due to the MDCT transformation of the decoded output of NB, the overall quality could be still better than the solutions of keeping the synchronization. FIG. 9 shows an example.

Figure 12:
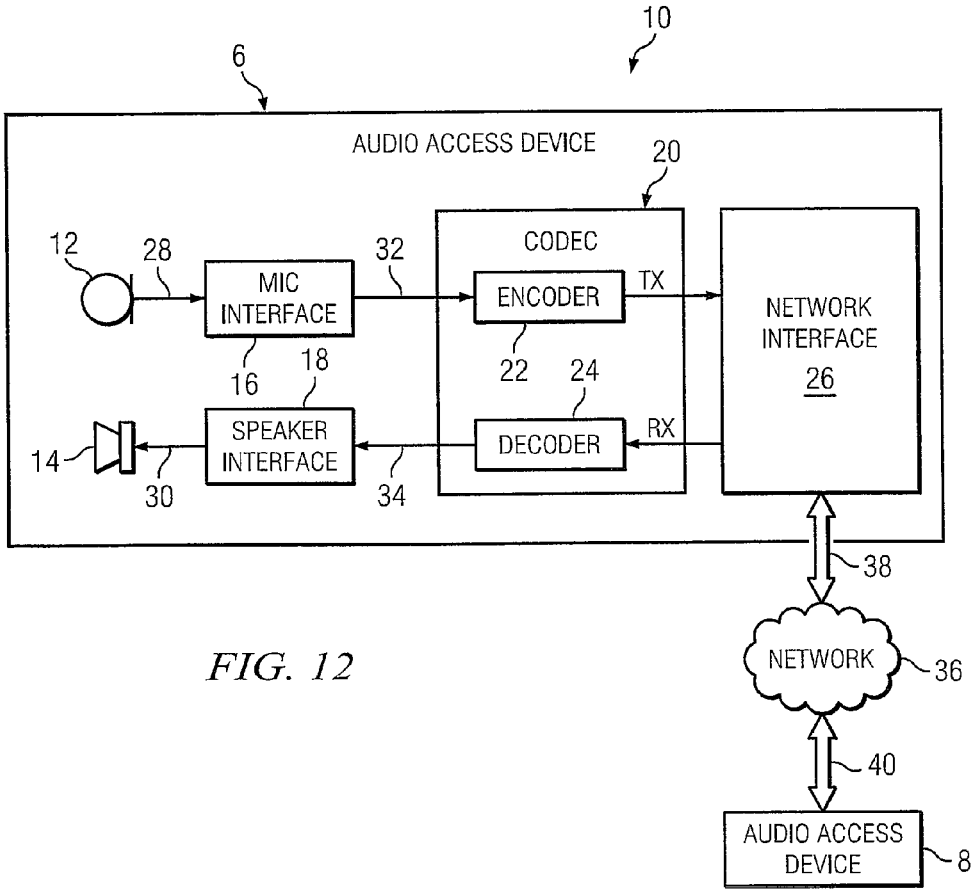
FIG. 12. illustrates a communication system according to an embodiment of the present invention.

FIG. 12 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VOIP) devices and network 36 is a wide area network (WAN), public switched telephone network (PTSN) and/or the internet. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In embodiments of the present invention, where audio access device 6 is a VOIP device, some or all of the components within audio access device 6 are implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

The above description contains specific information pertaining to the selective and/or adaptive ways to generate the extended fine spectrum. However, one skilled in the art will recognize that the present invention may be practiced in conjunction with various encoding/decoding algorithms different from those specifically discussed in the present application. Moreover, some of the specific details, which are within the knowledge of a person of ordinary skill in the art, are not discussed to avoid obscuring the present invention.

The drawings in the present application and their accompanying detailed description are directed to merely example embodiments of the invention. To maintain brevity, other embodiments of the invention which use the principles of the present invention are not specifically described in the present application and are not specifically illustrated by the present drawings.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method of receiving an audio signal, the method comprising:

measuring a periodicity of the audio signal to determine a checked periodicity;

if the checked periodicity of the audio signal is lower than a threshold, composing at least one extended subband in a frequency domain, wherein composing comprises reducing a ratio of copied harmonic components to composed or copied noise components if the checked periodicity is lower than the threshold, and generating an extended fine spectral structure in the frequency domain based on adding the copied harmonic components and the composed or copied noise components of at least one subband; and scaling a magnitude of the at least one extended subband based on a spectral envelope on the audio signal, wherein the steps of measuring, composing, reducing, generating and scaling are performed using a hardware-based audio decoder.

2. The method of claim 1, wherein the copied harmonic components are from a low band, and the at least one extended subband is in a high band.

3. The method of claim 1, wherein reducing the ratio comprises increasing magnitudes of the composed noise components.

4. The method of claim 1, further comprising filling 0 bit subbands, wherein spectral fine structure information of each 0 bit subband is not transmitted.

5. The method of claim 1, further comprising recovering subbands lost during transmission.

6. The method of claim 1, further comprising:

generating the extended fine spectral structure comprises generating the extended fine spectral structure according to the expression:

$$S_{BWE}(k)=g_h\cdot\hat{S}_{LB}^{celp,w}(k)+g_n\cdot\hat{D}_{LB}^{w}(k);$$

wherein $\hat{S}_{LB}^{celp,w}(k)$ represents the copied harmonic components from a low band and $\hat{D}_{LB}^{w}(k)$ represents the copied noise components from the low band, and $g_h$ and $g_n$ control relative energy between the $\hat{S}_{LB}^{celp,w}(k)$ component and the $\hat{D}_{LB}^{w}(k)$ component.

7. The method of claim 6, wherein:

an ITU-T G.729.1 codec is used as a core of an extended codec; and generating the extended spectral fine structure is performed instead of an ITU-T G.729.1 time domain bandwidth extension (TDBWE) function.

8. The method of claim 6, wherein:

if periodicity parameter $\overline{G}_p \leqq 0.5$, $g_h=1-0.9\ (0.5-\overline{G}_p)/0.5$ and $g_n=1$; otherwise, $g_h=1$ and $g_n=1$, wherein $\overline{G}_p$ represents a smoothed one of $G_p=E_p/(E_c+E_p)$, $0<G_p<1$, $E_c$ represent an energy of CELP fixed codebook contributions, and $E_p$ represents an energy of a CELP adaptive codebook contribution.

9. The method of claim 1, wherein:

the audio signal comprises an encoded audio signal; and the method further comprises converting the at least one extended subband into an output audio signal.

10. The method of claim 9, wherein converting the at least one extended subband into an output audio signal comprises driving a loudspeaker.

11. The method of claim 1, further comprising receiving the audio signal from a voice over internet protocol (VOIP) network.

12. The method of claim 1, further comprising receiving the audio signal from a mobile telephone network.

13. The method of claim 1, wherein using the hardware-based audio decoder comprises performing the steps of composing, reducing, generating and scaling using a processor.

14. The method of claim 1, wherein using the hardware-based audio decoder comprises performing the steps of composing, reducing, generating and scaling using dedicated hardware.

15. A method of decoding an encoded audio signal, the method comprising:

dividing an available low band of the encoded audio signal into a plurality of available subbands;

determining if each available subband comprises adequate harmonic content;

selecting available subbands that have adequate harmonic content based on the determining; and composing an extended high band from copying the selected available subbands, wherein composing is performed in a frequency domain and the steps of dividing, determining, selecting and composing are performed using a hardware-based audio decoder.

16. The method of claim 15, wherein determining comprises measuring a periodicity of a time domain signal based on the encoded audio signal.

17. The method of claim 15, wherein determining comprises estimating a spectral regularity of the encoded audio signal and a spectral sharpness of the encoded audio signal.

18. The method of claim 15, wherein composing comprises using a quadrature minor filter (QMF) filterbank.

19. The method of claim 15, wherein composing comprises repeatedly copying the available subbands that have adequate harmonic content to the extended high band.

20. The method of claim 15, further comprising converting the extended high band to produce an output audio signal.

21. The method of claim 15, wherein using the hardware-based audio decoder comprises performing the steps of dividing, determining, selecting and composing using a processor.

22. The method of claim 15, wherein using the hardware-based audio decoder comprises performing the steps of dividing, determining, selecting and composing using dedicated hardware.

23. A system for receiving an encoded audio signal, the system comprising:

a receiver configured to receive the encoded audio signal, the receiver comprising a hardware-based audio decoder configured to:

measure a periodicity of the audio signal to determine a checked periodicity, and compose at least one extended subband in a frequency domain if the checked periodicity is lower than a threshold by reducing a ratio of copied harmonic components to composed or copied noise components of the least one extended subband, and scaling a magnitude of the at least one extended subband based on a spectral envelope of the audio signal to produce a scaled extended subband.

24. The system of claim 23, wherein the receiver is further configured to convert the scaled extended subband to an output audio signal.

25. The system of claim 24, wherein:

the receiver is configured to be coupled to a voice over internet protocol (VOIP) network; and the output audio signal is configured to be coupled to a loudspeaker.

26. The system of claim 23, wherein the hardware-based audio decoder comprises a processor.

27. The system of claim 23, wherein the hardware-based audio decoder comprises dedicated hardware.

* * * * *

UNITED STATES PATENT AND TRADEMARK OFFICE

CERTIFICATE OF CORRECTION

PATENT NO. : 8,532,998 B2
APPLICATION NO. : 12/554638
DATED : September 10, 2013
INVENTOR(S) : Yang Gao It is certified that error appears in the above-identified patent and that said Letters Patent is hereby corrected as shown below:

In the Specification

In Col. 2, line 42, Background – G729.1 Encoder, delete "$s_{LB}^{qmf}(n)$" and insert -- $s_{LB}^{qmf}(n)$ --.

In Col. 2, line 49, Background – G729.1 Encoder, delete "$W_{LB}(Z)$" and insert -- $W_{LB}(z)$ --.

In Col. 2, line 53, Background – G729.1 Encoder, delete "$d_{LB}^{w}(n)$" and insert -- $d_{LB}^{w}(n)$ --.

In Col. 2, line 55, Background – G729.1 Encoder, delete "$d_{LB}^{w}(n)$" and insert -- $d_{LB}^{w}(n)$ --.

In Col. 2, line 56, Background – G729.1 Encoder, delete "$s_{HB}^{fold}(n)$" and insert -- $s_{HB}^{fold}(n)$ --.

In Col. 2, line 62, Background – G729.1 Encoder, delete "$D_{LB}^{w}(k)$" and insert -- $D_{LB}^{w}(k)$ --.

In Col. 3, line 37, Background – G729.1 Decoder, delete "$\hat{s}_{LB}^{post}(n)$" and insert -- $\hat{s}_{LB}^{post}(n)$, --.

In Col. 3, line 38, Background – G729.1 Decoder, delete "$\hat{s}_{LB}^{qmf}(n) = \hat{s}_{LB}^{hpf}(n)$" and insert -- $\hat{s}_{LB}^{qmf}(n) = \hat{s}_{LB}^{hpf}(n)$ --.

In Col. 3, line 41, Background – G729.1 Decoder, delete "$\hat{s}_{HB}^{qmf}(n)$" and insert -- $\hat{s}_{HB}^{qmf}(n)$ --.

In Col. 3, line 45, Background – G729.1 Decoder, delete "$\hat{s}_{LB}^{post}(n)$" and insert -- $\hat{s}_{LB}^{post}(n)$ --.

In Col. 3, line 46, Background – G729.1 Decoder, delete "$\hat{s}_{LB}^{qmf}(n) = \hat{s}_{LB}^{hpf}(n)$" and insert -- $\hat{s}_{LB}^{qmf}(n) = \hat{s}_{LB}^{hpf}(n)$ --.

In Col. 3, line 47, Background – G729.1 Decoder, delete "$\hat{s}_{HB}^{qmf}$" and insert -- $\hat{s}_{HB}^{qmf}$ --.

In Col. 3, line 52, Background – G729.1 Decoder, delete "$\hat{s}_{HB}^{bwe}$" and insert -- $\hat{s}_{HB}^{bwe}(n)$ --.

In Col. 3, line 54, Background – G729.1 Decoder, delete "$\hat{S}_{HB}^{bwe}(k)$" and insert -- $\hat{S}_{HB}^{bwe}(k)$ --.

Signed and Sealed this
Seventh Day of January, 2014

Margaret A. Focarino

Margaret A. Focarino
*Commissioner for Patents of the United States Patent and Trademark Office*

In Col. 3, line 58, Background – G729.1 Decoder, delete "$\hat{s}_{HB}^{qmf}(n)$" and insert -- $\hat{s}_{HB}^{qmf}(n)$--.

In Col. 3, line 59, Background – G729.1 Decoder, delete "$\hat{s}_{LB}^{qmf}(n) = \hat{s}_{LB}^{post}(n)$" and insert -- $\hat{s}_{LB}^{qmf}(n) = \hat{s}_{LB}^{post}(n)$ --.

In Col. 3, line 63, Background – G729.1 Decoder, delete "$\hat{D}_{LB}^{w}(k)$" and insert -- $\hat{D}_{LB}^{w}(k)$ --.

In Col. 4, line 2, Background – G729.1 Decoder, delete "$\hat{S}_{HB}^{bwe}(k)$. Both $\hat{D}_{LB}^{w}(k)$" and insert -- $\hat{S}_{HB}^{bwe}(k)$. Both $\hat{D}_{LB}^{w}(k)$ --.

In Col. 4, line 4, Background – G729.1 Decoder, delete "$\hat{d}_{LB}^{w}(n)$" and insert -- $\hat{d}_{LB}^{w}(n)$ --.

In Col. 4, line 9, Background – G729.1 Decoder, delete "$\hat{s}_{HB}^{fold}(n)$" and insert -- $\hat{s}_{HB}^{fold}(n)$ --.

In Col. 4, lines 10 - 11, Background – G729.1 Decoder, delete "$\hat{s}_{LB}^{qmf}(n) = \hat{s}_{LB}^{post}(n)$ and $\hat{s}_{HB}^{qmf}(n)$" and insert -- $\hat{s}_{LB}^{qmf}(n) = \hat{s}_{LB}^{post}(n)$ and $\hat{s}_{HB}^{qmf}(n)$ --.

In Col. 4, line 19, Background – TDBWE Decoder, delete "$\hat{s}_{HB}^{exc}(n)$" and insert -- $\hat{s}_{HB}^{exc}(n)$ --.

In Col. 5, lines 27 - 28, Background – TDBWE Decoder, delete "$g_v = \sqrt{\frac{1}{2}\left(g'^{2}_{v} + g'^{2}_{v,old}\right)}$" and insert -- $g_v = \sqrt{\frac{1}{2}\left(g'^{2}_{v} + g'^{2}_{v,old}\right)}$ --.

In Col. 5, line 32, Background – TDBWE Decoder, delete "$g_v^2 + g_{uv}^2 = 1$" and insert -- $g_v^2 + g_{uv}^2 = 1$ --.

In Col. 6, line 51, Background – TDBWE Decoder, delete "$n_{Pulse,\text{int}}^{[p]}$" and insert -- $n_{Pulse,\text{int}}^{[p]}$ --.

In Col. 6, line 57, Background – TDBWE Decoder, delete "$g_{Pulse}^{[p]}$" and insert -- $g_{Pulse}^{[p]}$ --.

In Col. 7, line 1, Background – TDBWE Decoder, delete "$n_{Pulse,\text{int}}^{[p]}$" and insert -- $n_{Pulse,\text{int}}^{[p]}$ --.

In Col. 7, line 2, Background – TDBWE Decoder, delete "$n_{Pulse,\text{int}}^{[p-1]}$" and insert -- $n_{Pulse,\text{int}}^{[p-1]}$ --.

In Col. 7, line 21, Background – TDBWE Decoder, delete "$g_{Pulse}^{[p]}$" and insert -- $g_{Pulse}^{[p]}$ --.

In Col. 7, line 25, Background – TDBWE Decoder, delete "$g_{Pulse}^{[p]} = \left(2 \cdot even(n_{Pulse,\text{int}}^{[p]}) - 1\right) \cdot g_v \cdot \sqrt{6t_{0,\text{int}} + t_{0,frac}}$" and insert -- $g_{Pulse}^{[p]} = \left(2 \cdot even(n_{Pulse,\text{int}}^{[p]}) - 1\right) \cdot g_v \cdot \sqrt{6t_{0,\text{int}} + t_{0,frac}}$ --.

In Col. 7, line 36, Background – TDBWE Decoder, delete "$s_{HB}^{exc}(n)$" and insert -- $s_{HB}^{exc}(n)$ --.

In Col. 7, line 44, Background – TDBWE Decoder, delete "$s_{HB}^{exc}(n)$" and insert -- $s_{HB}^{exc}(n)$ --.

In Col. 7, line 45, Background – TDBWE Decoder, delete "$\hat{s}_{HB}^{T}(n)$" and insert -- $\hat{s}_{HB}^{T}(n)$ --.

In Col. 7, line 49, Background – TDBWE Decoder, delete "$s_{HB}^{exc}(n)$" and insert -- $s_{HB}^{exc}(n)$--.

In Col. 7, line 50, Background – TDBWE Decoder, delete "$s_{HB}^{exc}(n)$" and insert -- $s_{HB}^{exc}(n)$--.

In Col. 7, line 53, Background – TDBWE Decoder, delete "$s_{HB}^{exc}(n)$" and insert -- $s_{HB}^{exc}(n)$--.

In Col. 7, line 55, Background – TDBWE Decoder, delete "$s_{HB}^{exc}(n)$" and insert -- $s_{HB}^{exc}(n)$--.

In Col. 7, line 65, Background – TDBWE Decoder, delete "$\hat{s}_{HB}^{T}(n)$" and insert -- $\hat{s}_{HB}^{T}(n)$--.

In Col. 8, line 11, Background – TDBWE Decoder, delete "$\hat{s}_{HB}^{F}(n)$" and insert -- $\hat{s}_{HB}^{F}(n)$--.

In Col. 8, line 13, Background – TDBWE Decoder, delete "$s_{HB}^{exc}(n)$" and insert -- $s_{HB}^{exc}(n)$--.

In Col. 8, line 17, Background – TDBWE Decoder, delete "$\hat{s}_{HB}^{F}(n)$" and insert -- $\hat{s}_{HB}^{F}(n)$--.

In Col. 8, line 18, Background – TDBWE Decoder, delete "$\hat{s}_{HB}^{F}$. Each sample of $\hat{s}_{HB}^{F}(n)$" and insert -- $\hat{s}_{HB}^{F}$. Each sample of $\hat{s}_{HB}^{F}(n)$--.

In Col. 8, line 20, Background – TDBWE Decoder, delete "$\hat{s}_{HB}^{F}(n)$" and insert -- $\hat{s}_{HB}^{F}(n)$--.

In Col. 8, line 22, Background – TDBWE Decoder, delete "$\hat{s}_{HB}^{bwe}(n)$" and insert -- $\hat{s}_{HB}^{bwe}(n)$--.

In Col. 9, line 3, Summary of the Invention, delete "$g_h \cdot \hat{S}_{LB}^{celp,w}(k) + g_n \cdot \hat{D}_{LB}^{w}(k)$" and insert -- $g_h \cdot \hat{S}_{LB}^{celp,w}(k) + g_n \cdot \hat{D}_{LB}^{w}(k)$--.

In Col. 9, line 4, Summary of the Invention, delete "$\hat{S}_{LB}^{celp,w}(k)$" and insert -- $\hat{S}_{LB}^{celp,w}(k)$--.

In Col. 9, line 5, Summary of the Invention, delete "$\hat{D}_{LB}^{w}(k)$" and insert -- $\hat{D}_{LB}^{w}(k)$--.

In Col. 9, line 6, Summary of the Invention, delete "$\hat{S}_{LB}^{celp,w}(k)$ component and $\hat{D}_{LB}^{w}(k)$" and insert -- $\hat{S}_{LB}^{celp,w}(k)$ component and $\hat{D}_{LB}^{w}(k)$--.

In Col. 13, line 19, Detailed Description of Illustrative Embodiments, delete "$\hat{s}_{LB}(n) = \hat{s}_{LB}^{celp}(n) + \hat{d}_{LB}(n)$" and insert -- $\hat{s}_{LB}(n) = \hat{s}_{LB}^{celp}(n) + \hat{d}_{LB}(n)$--.

In Col. 13, line 23, Detailed Description of Illustrative Embodiments, delete "$\hat{s}_{LB}(n) = \hat{s}_{LB}^{celp}(n) + \hat{d}_{LB}^{echo}(n)$" and insert -- $\hat{s}_{LB}(n) = \hat{s}_{LB}^{celp}(n) + \hat{d}_{LB}^{echo}(n)$--.

In Col. 13, line 26, Detailed Description of Illustrative Embodiments, delete "$\hat{s}_{LB}^{w}(n) = \hat{s}_{LB}^{celp,w}(n) + \hat{d}_{LB}^{w}(n)$" and insert -- $\hat{s}_{LB}^{w}(n) = \hat{s}_{LB}^{celp,w}(n) + \hat{d}_{LB}^{w}(n)$--.

In Col. 13, line 28, Detailed Description of Illustrative Embodiments, delete "$\hat{S}_{LB}^{w}(k) = \hat{S}_{LB}^{celp,w}(k) + \hat{D}_{LB}^{w}(k)$" and insert -- $\hat{S}_{LB}^{w}(k) = \hat{S}_{LB}^{celp,w}(k) + \hat{D}_{LB}^{w}(k)$--.

In Col. 13, line 30, Detailed Description of Illustrative Embodiments, delete "$\hat{S}_{LB}^{celp,w}(k)$ comes from CELP codec output; and $\hat{D}_{LB}^{w}$" and insert -- $\hat{S}_{LB}^{celp,w}(k)$ comes from CELP codec output; and $\hat{D}_{LB}^{w}$--.

In Col. 13, line 34, Detailed Description of Illustrative Embodiments, delete "$\hat{S}_{LB}{}^{celp,w}(k)$" and insert -- $\hat{S}_{LB}^{celp,w}(k)$ --.

In Col. 13, line 35, Detailed Description of Illustrative Embodiments, delete "$\hat{D}_{LB}{}^{w}(k)$" and insert -- $\hat{D}_{LB}^{w}(k)$ --.

In Col. 13, line 41, Detailed Description of Illustrative Embodiments, delete "$0 < G_p 1$" and insert -- $0 < G_p < 1$ --.

In Col. 13, line 47, Detailed Description of Illustrative Embodiments, delete "$\{\hat{S}_{LB}{}^{w}(k)\}$" and insert -- $\{\hat{S}_{LB}^{w}(k)\}$ --.

In Col. 13, line 49, Detailed Description of Illustrative Embodiments, delete "$\hat{S}_{LB}{}^{w}(k)$" and insert -- $\hat{S}_{LB}^{w}(k)$ --.

In Col. 13, lines 51 - 52, Detailed Description of Illustrative Embodiments, delete "$S_{BWE}(k) = g_h \cdot \hat{S}_{LB}{}^{celp,w}(k) + g_n \cdot \hat{D}_{LB}{}^{w}(k)$" and insert -- $S_{BWE}(k) = g_h \cdot \hat{S}_{LB}^{celp,w}(k) + g_n \cdot \hat{D}_{LB}^{w}(k)$ --.

In Col. 13, line 53, Detailed Description of Illustrative Embodiments, delete "and $g_h = 1$" and insert -- and $g_n = 1$ --.

In Col. 14, line 54, Detailed Description of Illustrative Embodiments, delete "$\hat{s}_{LB}{}^{celp}(n)$" and insert -- $\hat{s}_{LB}^{celp}(n)$ --.

In Col. 14, line 56, Detailed Description of Illustrative Embodiments, delete "$s_{LB}{}^{celp}(n)$" and insert -- $s_{LB}^{celp}(n)$ --.

In Col. 15, line 2, Detailed Description of Illustrative Embodiments, delete "$\hat{s}_{LB}{}^{celp}(n)$" and insert -- $\hat{s}_{LB}^{celp}(n)$ --.

In Col. 15, line 4, Detailed Description of Illustrative Embodiments, delete "$\hat{S}_{LB}{}^{celp,w}(k)$" and insert -- $\hat{S}_{LB}^{celp,w}(k)$ --.

In Col. 15, line 5, Detailed Description of Illustrative Embodiments, delete "$\hat{D}_{LB}{}^{w}{}_{B}(k)$" and insert -- $\hat{D}_{LB}^{w}(k)$ --.

In Col. 15, line 6, Detailed Description of Illustrative Embodiments, delete "$\hat{S}LB^{w}(k) = \hat{S}_{LB}{}^{celp,w}(k) + \hat{D}_{LB}{}^{w}(k)$" and insert -- $\hat{S}_{LB}^{w}(k) = \hat{S}_{LB}^{celp,w}(k) + \hat{D}_{LB}^{w}(k)$ --.

In Col. 15, line 23, Detailed Description of Illustrative Embodiments, delete "[0.4 kHz]" and insert --[0,4 kHz]--.

In Col. 15, line 24, Detailed Description of Illustrative Embodiments, delete "$S_{LB}{}^{w}(k)$" and insert -- $\hat{S}_{LB}^{w}(k)$ --.

In Col. 15, line 63, Detailed Description of Illustrative Embodiments, delete "[0.4 kHz]" and insert --[0,4 kHz]--.

In Col. 15, line 65, Detailed Description of Illustrative Embodiments, delete "$\hat{s}_{HB}^{qmf}(n)$" and insert -- $\hat{s}_{HB}^{qmf}(n)$--.

In Col. 15, line 67, Detailed Description of Illustrative Embodiments, delete "$\hat{s}_{HB}^{qmf}(n)$" and insert -- $\hat{s}_{HB}^{qmf}(n)$ --.

In Col. 16, line 22, Detailed Description of Illustrative Embodiments, delete "[0.4 kHz]" and insert --[0,4 kHz]--.

In Col. 16, line 24, Detailed Description of Illustrative Embodiments, delete "$\hat{s}_{LB}^{qmf}(n)$" and insert -- $\hat{s}_{LB}^{qmf}(n)$--.

In Col. 16, line 26, Detailed Description of Illustrative Embodiments, delete "$\hat{s}_{LB}^{qmf}(n)$" and insert -- $\hat{s}_{LB}^{qmf}(n)$ --.